US011355069B2

(12) United States Patent
Lee et al.

(10) Patent No.: US 11,355,069 B2
(45) Date of Patent: Jun. 7, 2022

(54) DISPLAY DEVICE, GATE DRIVING CIRCUIT, AND DRIVING METHOD THEREOF

(71) Applicant: LG Display Co., Ltd., Seoul (KR)

(72) Inventors: SangJae Lee, Gyeonggi-do (KR); SungJoong Kim, Gyeonggi-do (KR); Kyuhwan Joo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 25 days.

(21) Appl. No.: 16/913,535

(22) Filed: Jun. 26, 2020

(65) Prior Publication Data

US 2021/0005145 A1 Jan. 7, 2021

(30) Foreign Application Priority Data

Jul. 3, 2019 (KR) ..... 10-2019-0080079
Jun. 15, 2020 (KR) ..... 10-2020-0072325

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/0272* (2013.01)

(58) Field of Classification Search
CPC ..... G09G 3/3266; G09G 3/3291
USPC ..... 345/204, 211; 326/16
See application file for complete search history.

(56) References Cited

U.S. PATENT DOCUMENTS

| | | | | |
|---|---|---|---|---|
| 8,427,195 | B1 * | 4/2013 | Lee | H03K 19/21 326/16 |
| 8,427,397 | B2 | 4/2013 | Kwon et al. | |
| 11,037,499 | B2 * | 6/2021 | Kim | G09G 3/3266 |
| 11,107,404 | B2 * | 8/2021 | Park | G09G 3/3291 |
| 2014/0375616 | A1 * | 12/2014 | Kim | G09G 3/3266 345/211 |
| 2017/0193923 | A1 | 7/2017 | Park et al. | |
| 2019/0130842 | A1 * | 5/2019 | Jang | G09G 3/3266 |
| 2020/0013341 | A1 * | 1/2020 | Kim | G09G 3/3266 |

FOREIGN PATENT DOCUMENTS

| | | | |
|---|---|---|---|
| JP | 2003-271110 | A | 9/2003 |
| JP | 2008-257271 | A | 10/2008 |
| JP | 2010-020314 | A | 1/2010 |
| JP | 2012-083638 | A | 4/2012 |
| JP | 2017-120409 | A | 7/2017 |

* cited by examiner

*Primary Examiner* — Prabodh M Dharia
(74) *Attorney, Agent, or Firm* — Morgan, Lewis & Bockius LLP

(57) ABSTRACT

The present invention relates to a display device, a gate driving circuit, and a driving method thereof, and more specifically, to a display device, a gate driving circuit, and a driving method thereof capable of solving problems with insufficient charging time or image abnormalities by controlling supply timing of two gate signals, e.g., scan signals and sense signals.

17 Claims, 24 Drawing Sheets

DISPLAY DEVICE, GATE DRIVING CIRCUIT, AND DRIVING METHOD THEREOF

CROSS REFERENCE TO RELATED APPLICATION

This application claims priority from Korean Patent Application No. 10-2019-0080079, filed on Jul. 3, 2019 and Korean Patent Application No. 10-2020-0072325 filed on Jun. 15, 2020, each of which is hereby incorporated by reference for all purposes as if fully set forth herein.

BACKGROUND

1. Technical Field

Embodiments of the present disclosure relate to a display device, a gate driving circuit, and a driving method thereof.

2. Discussion of the Related Art

The development of an information-based society has brought increasing demands for various kinds of display devices for displaying images. Recently, various display devices such as liquid crystal displays, plasma displays, and organic light-emitting displays have been utilized.

Such display devices may charge a capacitor disposed in each of a plurality of subpixels arranged in a display panel, and may drive a display by utilizing the same. However, in the case of an exisitng display device, image quality may deteriorate due to insufficient charging in respective subpixels. In addition to this problem, the existing display device may exhibit a phenomenon in which images are not distinct and images are dragged, or may have a difference in brightness between line positions due to variation of light emission periods, thereby degrading the image quality.

SUMMARY

Accordingly, embodiments of the present disclosure are directed to a display device, a gate driving circuit, and a driving method thereof that substantially obviates one or more of the problems due to limitations and disadvantages of the related art.

Embodiments of the present disclosure may provide a display device, a gate driving circuit, and a driving method thereof capable of improving image quality by improving a charging rate through overlap driving on the subpixels.

In addition, embodiments of the present disclosure may provide a display device, a gate driving circuit, and a driving method thereof capable of improving image quality by preventing a phenomenon in which images are not distinct and images are draggedor a phenomenon of the difference in brightness between subpixel lines through fake data insertion driving in which fake images (e.g., black images, low-grayscale images, etc.) different from real images are intermittently inserted between the real images displayed.

In addition, embodiments of the present disclosure may provide a display device, a gate driving circuit, and a driving method thereof capable of obtaining advantages of both the overlap driving and the fake data insertion driving through an advanced overlap driving in which there is no change in the characteristics of the overlap driving due to the fake data insertion driving even if the fake data insertion driving is performed during the overlap driving.

In addition, embodiments of the present disclosure may provide a display device, a gate driving circuit, and a driving method thereof capable of preventing the occurrence of image abnormalities (e.g., a specific-line brightness phenomenon) immediately before the fake data insertion driving even if the fake data insertion driving is performed during the overlap driving.

Further, embodiments of the present disclosure may provide a display device, a gate driving circuit, and a driving method thereof capable of compensating for a reduction in the charging time by increasing the ratio of a channel width to a channel length of a sense transistor in addition to the advanced overlap driving.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

Embodiments of the present disclosure may provide a gate driving circuit including: a scan clock signal generator configured to receive a first reference scan clock signal and a second reference scan clock signal and configured to generate and output a scan clock signal; a sense clock signal generator configured to receive a first reference sense clock signal and a second reference sense clock signal and configured to generate and output a sense clock signal; and a gate signal outputter configured to output a scan signal having a turn-on level voltage interval, based on the scan clock signal, and configured to output a sense signal having a turn-on level voltage interval, based on the sense clock signal.

The second reference scan clock signal may rise and fall after the first reference scan clock signal rises and falls. The second reference sense clock signal may rise and fall after the first reference sense clock signal rises and falls.

The high-level gate voltage interval of the sense clock signal may be delayed from the high-level gate voltage interval of the scan clock signal by a predetermined sense shift time. Accordingly, the turn-on level voltage interval of the sense signal may be delayed from the turn-on level voltage interval of the scan signal by the sense shift time.

The scan clock signal generator may be configured to generate and output a scan clock signal that rises at a rising time of the first reference scan clock signal and falls at a falling time of the second reference scan clock signal.

The sense clock signal generator may be configured to generate and output a sense clock signal that rises at a rising time of the second reference sense clock signal, instead of a rising time of the first reference sense clock signal, and falls a predetermined delay time after the falling time of the second reference sense clock signal.

The time interval between the rising time of the first reference sense clock signal and the rising time of the second reference sense clock signal may correspond to the sense shift time.

The rising time of the first reference sense clock signal may be the same as the rising time of the first reference scan clock signal.

The rising time of the second reference sense clock signal may precede the rising time of the second reference scan clock signal.

The length of the time during which the scan clock signal and the sense clock signal overlap each other may correspond to a value obtained by subtracting the delay time from the temporal length of the turn-on level voltage interval of the sense signal.

The scan clock signal generator may include: a scan logic unit configured to receive the first reference scan clock signal and the second reference scan clock signal and to generate a scan clock signal that rises at the rising time of the first reference scan clock signal and falls at the falling time of the second reference scan clock signal; and a scan level shifter configured to output the scan clock signal, which rises to a high level gate voltage and falls to a low level gate voltage.

The sense clock signal generator may include: a sense logic unit configured to receive the first reference sense clock signal and the second reference sense clock signal and generate the sense clock signal that rises at the rising time of the second reference sense clock signal, instead of the rising time of the first reference sense clock signal, and falls a predetermined delay time after the falling time of the second reference sense clock signal; a delay device configured to delay the rising time of the sense clock signal such that the sense clock signal rises at the rising time of the second reference sense clock signal, instead of the rising time of the first reference sense clock signal; and a sense level shifter configured to output the sense clock signal that rises to the high level gate voltage and falls to the low level gate voltage and that has a high-level gate voltage interval delayed from the high-level gate voltage interval of the scan clock signal by the sense shift time.

The delay device may include one or more resistor elements.

In an aspect, embodiments of the present disclosure may provide a display device including: a display panel including a plurality of data lines, a plurality of scan signal lines, a plurality of sense signal lines, a plurality of reference lines, and a plurality of subpixels each including an emission element, a driving transistor configured to drive the emission element, a scan transistor configured to control a connection between the data line and a first node of the driving transistor according to a scan signal, a sense transistor configured to control a connection between the reference line and a second node of the driving transistor according to a sense signal, and a capacitor connected between the first node and the second node of the driving transistor; a data driving circuit configured to drive the plurality of data lines; a first gate driving circuit configured to supply a first scan signal having an interval of a turn-on level voltage to a first scan signal line electrically connected to a gate node of the scan transistor in a first subpixel included in the plurality of subpixels; and a second gate driving circuit configured to supply a first sense signal having an interval of a turn-on level voltage, which is delayed from the interval of a turn-on level voltage of the first scan signal by a predetermined sense shift time, to a first sense signal line electrically connected to a gate node of the sense transistor in the first subpixel.

The interval of a turn-on level voltage of the first sense signal may include a period in which the interval of a turn-on level voltage of the first sense signal overlaps the interval of a turn-on level voltage of the first scan signal and a period in which the interval of a turn-on level voltage of the first sense signal does not overlap the interval of a turn-on level voltage of the first scan signal.

The period in which the interval of a turn-on level voltage of the first sense signal overlaps the interval of a turn-on level voltage of the first scan signal corresponds to a programning period in which image data is programmed onto the first subpixel.

A start point of the interval of a turn-on level voltage of the first sense signal may be delayed from a start point of the interval of a turn-on level voltage of the first scan signal by a sense shift time.

The sense shift time may correspond to ½ of the interval of a turn-on level voltage of the first scan signal.

The plurality of subpixels may further include a second subpixel and a third subpixel, and drain nodes or source nodes of the sense transistors included in the first subpixel, the second subpixel, and the third subpixel may be electrically connected to the same reference line.

There may be a timing at which the sense transistor in the first subpixel and the sense transistor in the third subpixel are simultaneously turned off while a second scan signal having a turn-on level voltage is supplied to a gate node of the scan transistor in the second subpixel and while a second sense signal having a turn-on level voltage is supplied to a gate node of the sense transistor in the second subpixel.

A fake data voltage that is distinct from a real image data voltage may be supplied to subpixels arranged in k ("k" is a natural number of 1 or more) subpixel lines during a period between a period in which the $i^{th}$ ("i" is a natural number of 1 or more) scan signal having a turn-on level voltage is supplied to the $i^{th}$ scan signal line of the plurality of scan signal lines and a period in which the $(i+1)^{th}$ scan signal having a turn-on level voltage is supplied to the $(i+1)^{th}$ scan signal line of the plurality of scan signal lines.

In another aspect, embodiments of the present disclosure may provide a gate driving circuit including: a first gate driving circuit configured to supply a first scan signal having an interval of a turn-on level voltage to a first scan signal line electrically connected to a gate node of a scan transistor in a first subpixel included in a plurality of subpixels arranged on a display panel; and a second gate driving circuit configured to supply a first sense signal having an interval of a turn-on level voltage, which is delayed from the interval of a turn-on level voltage of the first scan signal by a predetermined sense shift time, to a first sense signal line electrically connected to a gate node of a sense transistor in the first subpixel.

The plurality of subpixels may further include a second subpixel and a third subpixel, and drain nodes or source nodes of the sense transistors included in the first subpixel, the second subpixel, and the third subpixel may be electrically connected to the same reference line.

There may be a timing at which the sense transistor in the first subpixel and the sense transistor in the third subpixel are simultaneously turned off while a second scan signal having a turn-on level voltage is supplied to a gate node of the scan transistor in the second subpixel and while a second sense signal having a turn-on level voltage is supplied to a gate node of the sense transistor in the second subpixel.

In another aspect, embodiments of the present disclosure may provide a method for driving a display device, which may include: supplying a first scan signal having an interval of a turn-on level voltage to a first scan signal line connected to a gate node of a scan transistor in a first subpixel among a plurality of subpixels, thereby transmitting an image data voltage supplied to a data line to a first node of a driving transistor in the first subpixel through the scan transistor; supplying a first sense signal having an interval of a turn-on level voltage, which is delayed from the interval of a turn-on level voltage of the first scan signal by a predetermined sense shift time, to a first sense signal line electrically connected to a gate node of a sense transistor in the first subpixel, thereby transmitting a reference voltage supplied to a reference line to a second node of the driving transistor through the sense transistor; and supplying the first scan signal having the interval of a turn-off level voltage to the first scan signal line and supplying the first sense signal having the interval of a turn-off level voltage to the first sense signal line.

The interval of a turn-on level voltage of the first sense signal may include a period in which the interval of a turn-on level voltage of the first sense signal overlaps the interval of a turn-on level voltage of the first scan signal and a period in which the interval of a turn-on level voltage of the first sense signal does not overlap the interval of a turn-on level voltage of the first scan signal.

A start point of the interval of a turn-on level voltage of the first sense signal may be delayed from a start point of the interval of a turn-on level voltage of the first scan signal by a sense shift time, and the sense shift time may correspond to ½ of the interval of a turn-on level voltage of the first scan signal.

The plurality of subpixels may further include a second subpixel and a third subpixel, and drain nodes or source nodes of the sense transistors included in the first subpixel, the second subpixel, and the third subpixel may be electrically connected to the same reference line.

There may be a timing at which the sense transistor in the first subpixel and the sense transistor in the third subpixel are simultaneously turned off While a second scan signal having a turn-on level voltage is supplied to a gate node of the scan transistor in the second subpixel and while a second sense signal having a turn-on level voltage is supplied to a gate node of the sense transistor in the second subpixel.

A fake data voltage that is distinct from a real image data voltage may be supplied to subpixels arranged in k ("k" is a natural number of 1 or more) subpixel lines during a period between a period in which the $i^{th}$ ("i" is a natural number of 1 or more) scan signal having a turn-on level voltage is supplied to the $i^{th}$ scan signal line of the plurality of scan signal lines and a period in which the $(i+1)^{th}$ scan signal having a turn-on level voltage is supplied to the $(i+1)^{th}$ scan signal line of the plurality of scan signal lines.

According to embodiments of the present disclosure, it is possible to improve image quality by improving a charging rate through overlap driving on the subpixels.

In addition, according to embodiments of the present disclosure, it is possible to improve the image quality by preventing a phenomenon in which images are not distinct and images are dragged or a phenomenon of the difference in brightness between subpixel lines through fake data insertion driving in which fake images (e.g., black images, low-grayscale images, etc.) different from real images are intermittently inserted between the real images displayed.

In addition, according to embodiments of the present disclosure, even if fake data insertion driving is performed during overlap driving, it is possible to perform control such that the characteristics of the overlap driving do not change immediately before the fake data insertion driving through advanced overlap driving in which the voltage interval of a turn-on level voltage of a sense signal among two gate signals (a scan signal and a sense signal) is controlled to be delayed from the voltage interval of a turn-on level voltage of a scan signal.

As a result, it is possible to prevent image abnormalities (e.g., a specific-line brightness phenomenon) that occur in a subpixel row immediately before the fake data insertion driving in the case where the fake data insertion driving is performed during the overlap driving.

Further, embodiments of the present disclosure are capable of compensating for a reduction in the charging time caused by the advanced overlap driving by increasing the ratio of a channel width to a channel length of a sense transistor in addition to the advanced overlap driving.

It is to be understood that both the foregoing general description and the following detailed description are exemplary and explanatory and are intended to provide further explanation of the inventive concepts as claimed.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
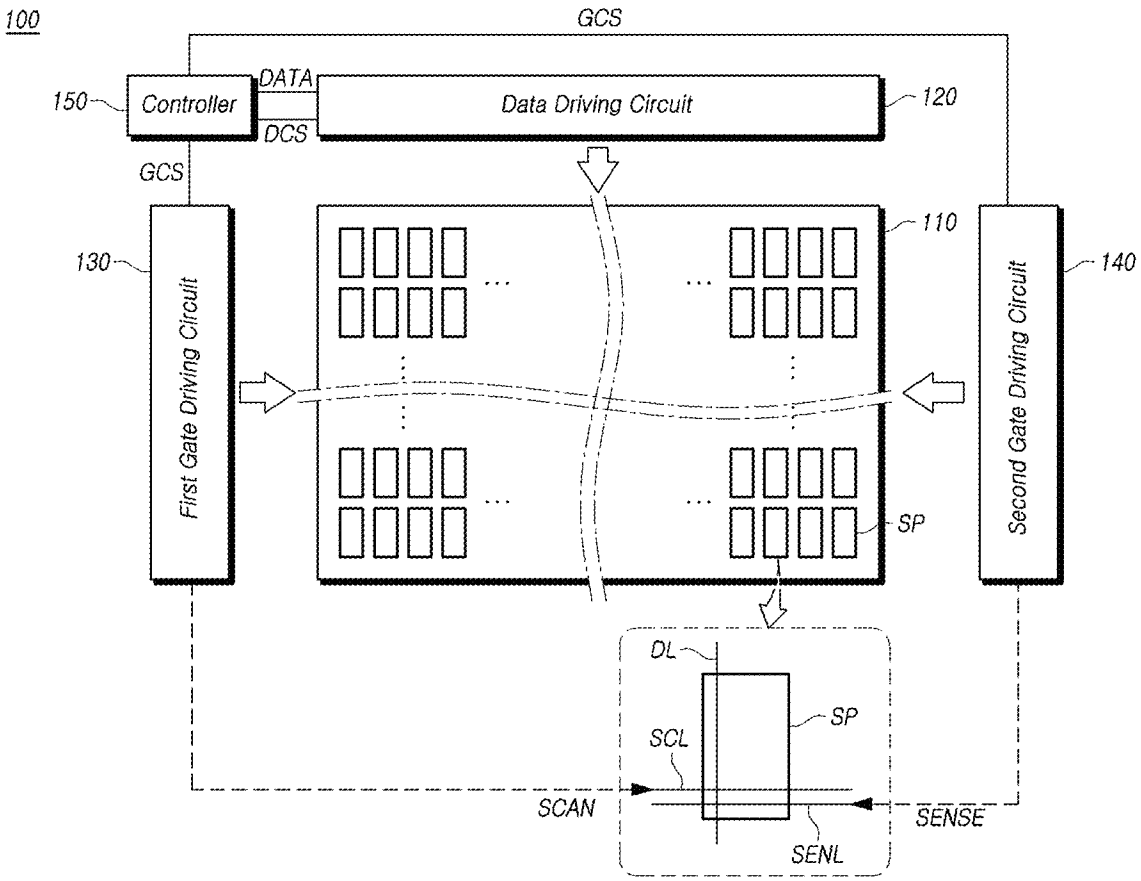
FIG. 1 is a diagram illustrating the system configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Hereinafter, embodiments of the present disclosure will be described in detail with reference to the accompanying drawings.

FIG. 1 is a diagram illustrating the system configuration of a display device 100 according to embodiments of the present disclosure.

Referring to FIG. 1, the display device 100 according to embodiments of the present disclosure may include a display panel 110, a data driving circuit 120, a first gate driving circuit 130, a second gate driving circuit 140, or the like, and may further include a controller 150.

The display panel 110 may include a plurality of data lines DL, a plurality of scan signal lines SCL, a plurality of sense signal lines SENL, a plurality of reference lines RL, a plurality of subpixels SP, and the like. The display panel 110 may include a display area and a non-display area. A plurality of subpixels SP for displaying images may be arranged in the display area. Driving circuits 120, 130, and 140 may be electrically connected or mounted to the non-display area, and a pad portion may be disposed therein.

The data driving circuit 120 is intended to drive the plurality of data lines DL, and may supply data voltages to the plurality of data lines DL.

The first gate driving circuit 130 sequentially supplies scan signals SCAN to the plurality of scan signal lines SCL that are a kind of gate line.

The second gate driving circuit 140 sequentially supplies sense signals to the plurality of sense signal lines that are a kind of gate line.

The controller 150 may control the data driving circuit 120, the first gate driving circuit 130, and the second gate driving circuit 140.

The controller 150 supplies various driving control signals DCS and GCS to the data driving cit 120, the first gate driving circuit 130, and the second gate driving circuit 140, thereby controlling the data driving circuit 120 for data driving, and the first gate driving circuit 130 and the second gate driving circuit 140 for gate driving.

The controller 150 starts scanning according to the timing implemented in each frame, converts input image data input from the outside in conformity with the data signal format used in the data driving circuit 120, outputs the converted image data DATA, and controls data driving at an appropriate time according to the scanning.

The controller 150 receives various timing signals including a vertical synchronization signal VSYNC, a horizontal synchronization signal HSYNC, an input data enable (DE) signal, a clock signal CLK, or the like, as well as the input image data, from the outside (e.g., a host system).

The controller 150 converts the input image data input from the outside in conformity with the data signal format used in the data driving circuit 120 and outputs the converted image data, and in order to control the data driving circuit 120, the first gate driving circuit 130, and the second gate driving circuit 140, the controller 150 further receives timing signals such as a vertical synchronization signal VSYNC, a horizontal synchronization signal HSYNC, an input data enable (DE) signal, a clock signal CLK, or the like, produces various control signals DCS and GCS, and outputs the same to the data driving circuit 120, the first gate driving circuit 130, and the second gate driving circuit 140.

For example, in order to control the first and second gate driving circuits 130 and 140, the controller 150 outputs various gate control signals GCS including a gate start pulse (GSP), a gate shift clock (GSC), a gate output enable signal (GOE), and the like.

In this case, the gate start pulse (GSP) controls operation start timing of one or more gate driver integrated circuits constituting each of the first and second gate driving circuits 130 and 140. The gate shift clock (GSC), which is a clock signal commonly input to one or more gate driver integrated circuits, controls shift timing of a scan signal (gate pulse). The gate output enable signal (GOE) specifies timing information on one or more gate driver integrated circuits.

In addition, in order to control the data driving circuit 120, the controller 150 outputs various data control signals DCS including a source start pulse (SSP), a source sampling clock (SSC), source output enable signal (SOE), and the like.

In this case, the source start pulse (SSP) controls data sampling start timing of one or more source driver integrated circuits constituting the data driving circuit 120. The source sampling clock (SSC) is a clock signal for controlling timing of sampling data in the respective source driver integrated circuits. The source output enable signal (SOE) controls output timing of the data driving circuit 120.

The controller 150 may be implemented as a separate component from the data driving circuit 120, or may be integrated with the data driving circuit 120 into an integrated circuit.

The data driving circuit 120 receives image data DATA from the controller 140 and supplies a data voltage to a plurality of data lines DL, thereby driving the plurality of data lines DL. Here, the data driving circuit 120 may also be referred to as a "source driving circuit".

The data driving circuit 120 may be implemented by including one or more source driver integrated circuits (SDICs).

Each source driver integrated circuit (SDIC) may include a shift register, a latch circuit, a digital-to-analog converter (DAC), an output buffer, and the like.

Each source driver integrated circuit (SDIC), in some cases, may further include an analog-to-digital converter (ADC).

Each source driver integrated circuit (SDIC) may be connected to a bonding pad of the display panel 110 by a tape automated bonding (TAB) method or a chip-on-glass (COG) method, or may be directly arranged on the display panel 110, and in some cases, the source driver integrated circuit (SDIC) may be integrated and arranged on the display panel 110. In addition, each source driver integrated circuit (SDIC) may be implemented by a chip-on-film (COF) method, and in this case, each source driver integrated circuit (SDIC) may be mounted on a film connected to the display panel 110, and may be electrically connected to the display panel 110 through wires on the film.

The first gate driving circuit 130 sequentially drives the plurality of scan signal lines SCL by sequentially supplying scan signals to the plurality of scan signal lines SCL. The first gate driving circuit 130, under the control of the controller 150, may output a scan signal having a turn-on level voltage or a scan signal having a turn-off level voltage.

The second gate driving circuit 140 sequentially drives the plurality of sense signal lines SENL by sequentially supplying sense signals to the plurality of sense signal lines SENL. The second gate driving circuit 140, under the control of the controller 150, may output a sense signal having a turn-on level voltage or a sense signal having a turn-off level voltage.

The plurality of scan signal lines SCL and the plurality of sense signal lines SENL correspond to gate lines. The scan signal and the sense signal correspond to gate signals applied to a gate node of a transistor.

The first and second gate driving circuits 130 and 140 may be implemented by including at least one gate driver integrated circuit (GDIC). Each gate driver integrated circuit (GDIC) may include a shift register, a level shifter, or the like.

Each gate driver integrated circuit (GDIC) may be connected to a bonding pad of the display panel 110 by a tape automated bonding (TAB) method or a chip-on-glass (COG) method, or may be implemented as a gate-in-panel (GIP) type to then be directly arranged on the display panel 110, and in some cases, the gate driver integrated circuit (GDIC) may be integrated and arranged on the display panel 110. In addition, each gate driver integrated circuit (GDIC) may be implemented by a chip-on-film (COF) method in which an element is mounted on a film connected to the display panel 110.

When a specific scan signal line SCL is opened by the first gate driving circuit 130, the data driving circuit 120 converts image data DATA received from the controller 150 into an analog data voltage and supplies the same to the plurality of data lines DL.

The data driving circuit 120 may be positioned only at one side (e.g., the upper side or the lower side) of the display panel 110, or in some cases, may be positioned at both sides of the display panel 110 (e.g., the upper side and the lower side) depending on a driving method, a panel design method, or the like.

The first and second gate driving circuits 130 and 140 may be positioned only at one side (e.g., the left side or the right side) of the display panel 110, or in some cases, may be positioned at both sides (e.g., the left side and the right side) of the display panel 110 depending on a driving method, a panel design method, or the like.

The controller 150 may be a timing controller used in the normal display technology, or may be a control device capable of further performing other control functions, including the timing controller. Alternatively, the controller 150 may be a control device other than the timing controller, and may be a circuit in the control device. The controller 150 may be implemented as a variety of circuits or electronic components such as an integrate circuit (IC), a field programmable gate array (FPGA), an application specific integrated circuit (ASIC), a processor, or the like.

The controller 150 may be mounted on a printed circuit board, a flexible printed circuit, or the like, and may be electrically connected to the data driving circuit 120, the first gate driving circuit 130, and the second gate driving circuit 140 through the printed circuit board, the flexible printed circuit, or the like.

The controller 150 may transmit and receive signals to and from the data driving circuit 120 using one or more predetermined interfaces. For example, the interfaces may include a low-voltage D differential signaling (LVDS) interface, an EPI interface, a serial peripheral interface (SPI), or the like.

The controller 150 may transmit and receive signals to and from the data driving circuit 120, the first gate driving circuit 130, and the second gate driving circuit 140 using one or more predetermined interfaces. For example, the interfaces may include a low-voltage D differential signaling (LVDS) interface, an EPI interface, a serial peripheral interface (SPI), or the like. The controller 150 may include storage such as one or more registers or the like.

The display device 100 according to embodiments of the present disclosure may be any type of display that includes an emission element in a subpixel SP. For example, the display device 100 according to embodiments of the present disclosure may be an OLED display, as an emission element in the subpixel SP, including an organic light-emitting diode (OLED), or may be an LED display, as an emission element within subpixel SP, including a light-emitting diode (LED).

Figure 2:
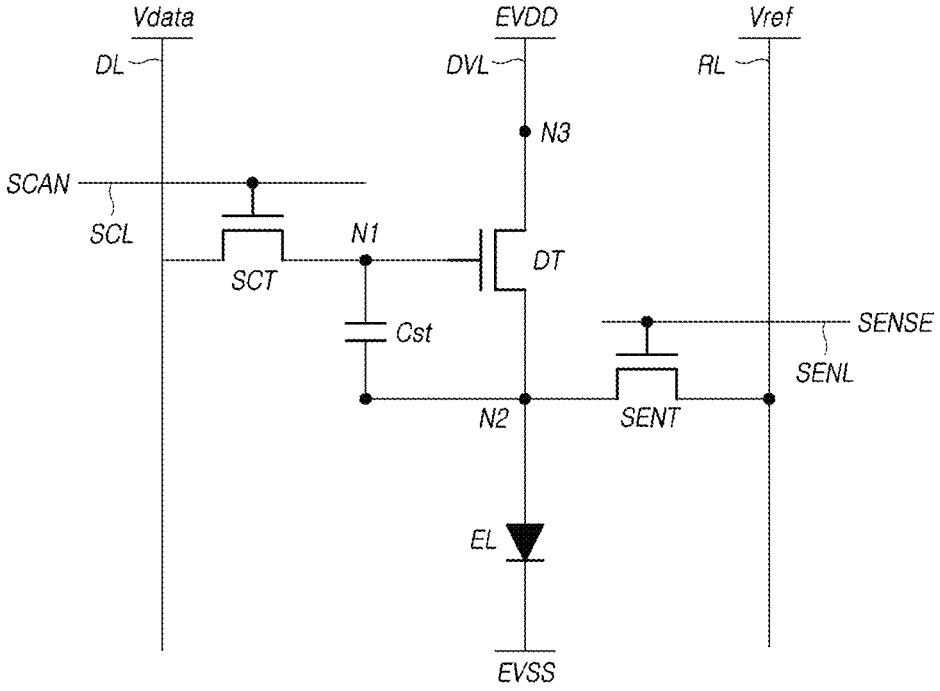
FIG. 2 is an equivalent circuit diagram of a subpixel disposed on a display panel of a display device according to embodiments of the present disclosure.

FIG. 2 is an equivalent circuit diagram of a subpixel SP disposed on a display panel 110 of a display device 100 according to embodiments of the present disclosure.

Referring to FIG. 2, each of a plurality of subpixels SP may include an emission element EL, three transistors DI, SCT, and SENT, and one capacitor Cst. This subpixel structure is called a "3T (transistors) 1C (capacitor) structure".

The three transistors DT, SCT, and SENT may include a driving transistor DI, a scan transistor SCT, and a sense transistor SENT.

The emission element EL may include a first electrode, a second electrode, and the like. In the emission element EL, the first electrode may be an anode electrode or a cathode electrode, and the second electrode may be a cathode electrode or an anode electrode. In the emission element EL in FIG. 2, the first electrode is an anode electrode corresponding to a pixel electrode provided in each subpixel SP, and the second electrode is a cathode electrode to which a base voltage EVSS corresponding to a common voltage is applied.

For example, the emission element EL may be an organic light-emitting diode (OLED) including a first electrode, an emission layer, and a second electrode, or may be implemented as a light-emitting diode (LED) or the like.

The driving transistor DT, which is a transistor for driving the emission element EL, may include a first node N1, a second node N2, a third node N3, or the like.

The first node N1 of the driving transistor DT may be a gate node, and may be electrically connected to a source node or a drain node of the scan transistor SCT.

The second node N2 of the driving transistor DT may be a source node or a drain node, may be electrically connected to a source node or a drain node of the sense transistor SENT, and may also be electrically connected to the first electrode of the emission element EL.

The third node N3 of the driving transistor DT may be electrically connected to a driving voltage line DVL that supplies a driving voltage EVDD.

The scan transistor SCT may be turned on or off according to scan signals SCAN supplied from the scan signal line SCL, thereby controlling a connection between the data line DL and the first node N1 of the driving transistor DT.

The scan transistor SCT may be turned on by a scan signal SCAN having a turn-on level voltage, and may then transmit the data voltage Vdata supplied through the data line DL to the first node N1 of the driving transistor DT.

The sense transistor SENT may be turned on or off according to sense signals SENSE supplied from the sense signal line SENL, thereby controlling a connection between the reference line RL and the second node N2 of the driving transistor DT.

The sense transistor SENT may be turned on by a sense signal SENSE having a turn-on level voltage, and may thus transmit a reference voltage Vref supplied from the reference line RL to the second node N2 of the driving transistor DT.

In addition, the sense transistor SENT may be turned on by a sense signal SENSE having a turn-on level voltage, and may transmit the voltage of the second node N2 of the driving transistor DT to the reference line RL.

The function in which the sense transistor SENT transfers the voltage of the second node N2 of the driving transistor DT to the reference line RL may be used in driving for sensing characteristic values (e.g., a threshold voltage, mobility, or the like) of the driving transistor DT. In this case, the voltage transmitted to the reference line RL may be intended to calculate the characteristic value of the driving transistor DT.

The function in which the sense transistor SENT transfers the voltage of the second node N2 of the driving transistor DT to the reference line RL may also be used in driving for sensing the characteristic values (e.g., a threshold voltage) of the emission element EL. In this case, the voltage transmitted to the reference line RL may be intended to calculate the characteristic value of the emission element EL.

Each of the driving transistor DT, the scan transistor SCT, and the sense transistor SENT may be an n-type transistor or a p-type transistor. Hereinafter, for the convenience of describing, it is assumed that each of the driving transistor DT, the scan transistor SCT, and the sense transistor SENT is an n-type transistor.

The capacitor Cst may be connected between the first node N1 and the second node N2 of the driving transistor DT. The capacitor Cst has charges corresponding to the voltage difference between both ends thereof and plays the role of maintaining the voltage difference between the both ends during a predetermined frame time. Accordingly, a corresponding subpixel SP may emit light during a predetermined frame time.

The capacitor Cst may be an external capacitor that is intentionally designed in the exterior of the driving transistor DT, instead of a parasitic capacitor (e.g., Cgs or Cgd) that is an internal capacitor present between the gate node and the source node (or drain node) of the driving transistor DT.

Figure 3:
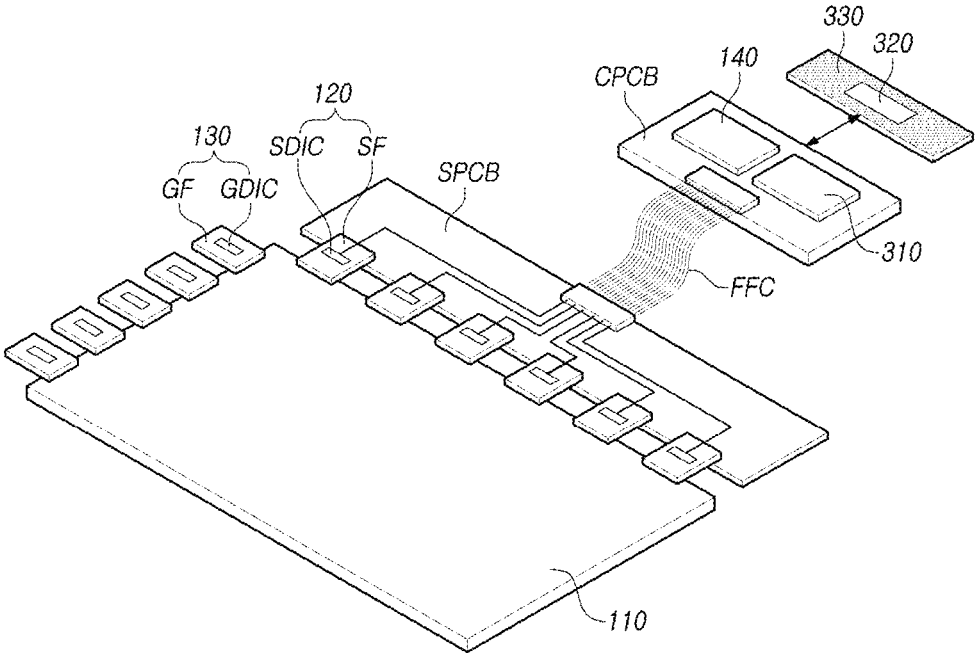
FIG. 3 is a diagram illustrating an example of implementing a system of a display device according to embodiments of the present disclosure.

FIG. 3 is a diagram illustrating an example of implementing a system of a display device 100 according to embodiments of the present disclosure.

Referring to FIG. 3, each gate driver integrated circuits GDIC may be mounted on a film GF connected to a display panel 110 in the case where it is implemented by a chip-on-film (COF) type.

Each source driver integrated circuits (SDIC) may be mounted on a film SF connected to the display panel 110 in the case where it is implemented by a chip-on-film (COF) type.

In order for circuit connections between a plurality of source driver integrated circuits (SDIC) and other devices, the display device 100 may include at least one source printed circuit board SPCB and a control printed circuit board CPCB on which control parts and a variety of electric devices are mounted.

The film SF on which the source driver integrated circuit SDIC is mounted may be connected to at least one source printed circuit board SPCB. That is, the film SF on which the source driver integrated circuit SDIC is mounted may be electrically connected to the display panel 110 at one side thereof, and may be electrically connected to the source printed circuit board SPCB at the other side thereof.

A controller 140 for controlling the operation of the data driving circuit 120, the gate driving circuit 130, or the like, a power management IC (PMIC) 410 for supplying a variety of voltages or currents to the display panel 110, the data driving circuit 120, and the gate driving circuit 130 or controlling the variety of voltages or currents to be supplied, and the like may be mounted on the control printed circuit board CPCB.

At least one source printed circuit board SPCB and control printed circuit board CPCB may be connected in circuits through at least one connection member. Here, the connection member may be, for example, a flexible printed circuit (FPC), a flexible flat cable (FFC), or the like.

At least one source printed circuit board SPCB and control printed circuit board CPCB may be integrated into a single printed circuit board.

The display device 100 may further include a set board 330 electrically connected to the control printed circuit board CPCB. The set board 330 may also be referred to as a "power board".

The set board 330 may have a main power management circuit (M-PMC) 320 for managing the overall power of the display device 100.

The power management IC 310 manages power of a display module including the display panel 110, the driving circuits 120, 130, and 140 thereof, and the like, and the main power management circuit 320 manages the overall power including the display module, and may interlock with the power management IC 310.

Figure 4:
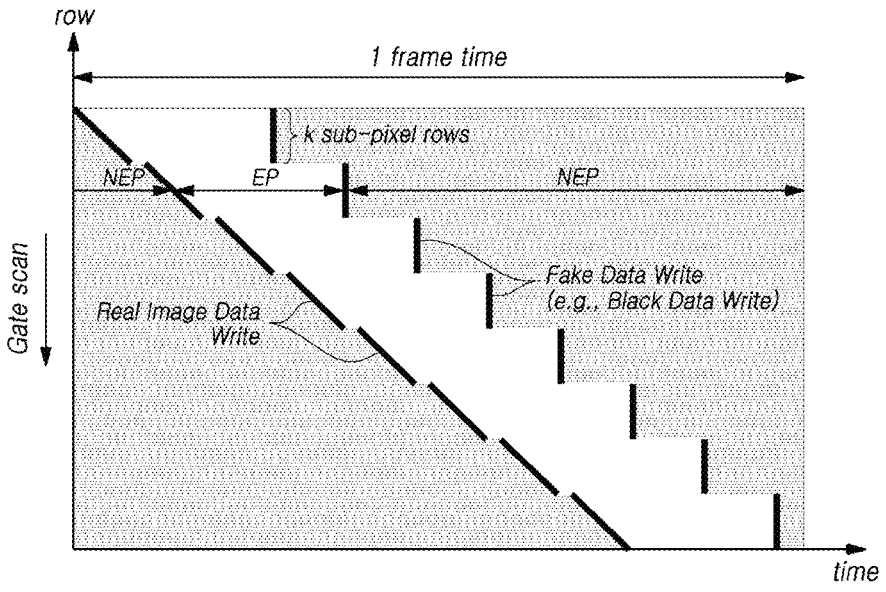
FIG. 4 is a diagram illustrating fake data insertion driving of a display device according to embodiments of the present disclosure.
Figure 5:
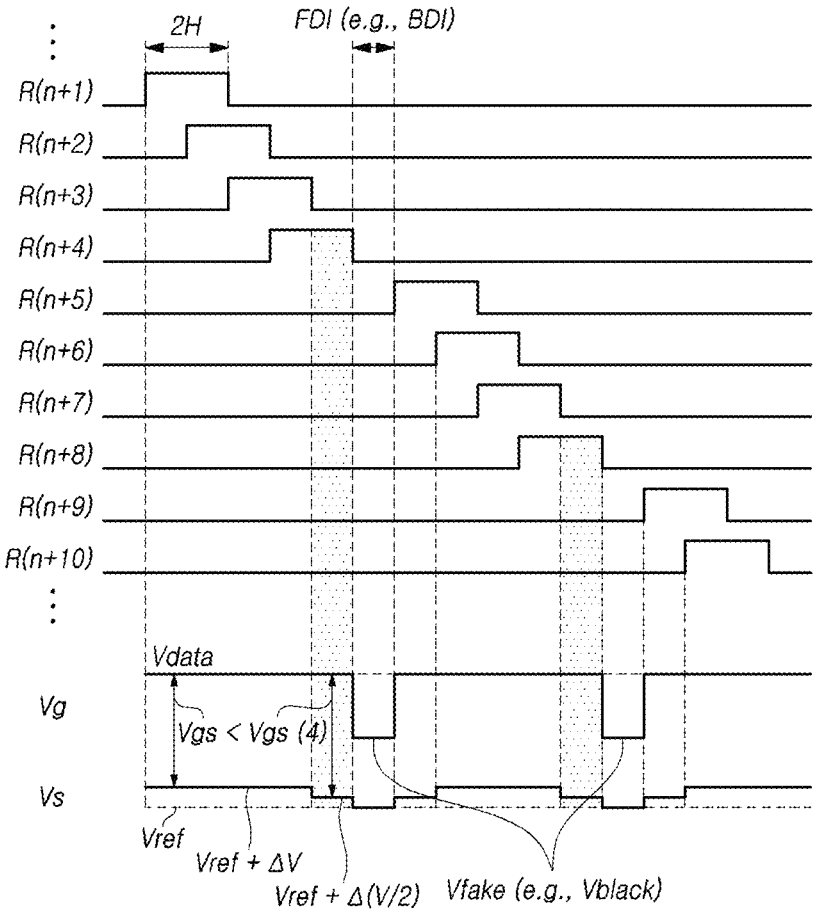
FIGS. 5 and 6 are driving timing diagrams in the case where a display device according to embodiments of the present disclosure performs fake data insertion driving and overlap driving.
Figure 6:
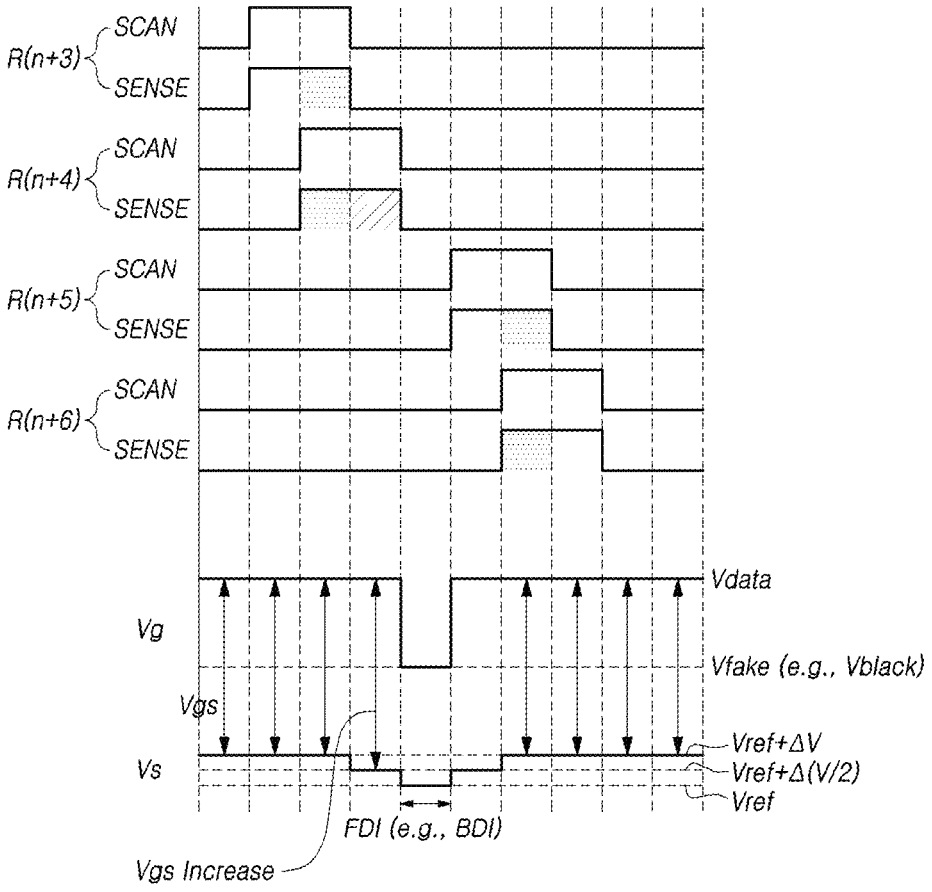

FIG. 4 is a diagram illustrating fake data insertion (FDI) driving of a display device 100 according to embodiments of the present disclosure. FIGS. 5 and 6 are driving timing diagrams in the case where a display device 100 according to embodiments of the present disclosure performs fake data insertion driving and overlap driving.

A plurality of subpixels SP may be arranged on the display panel 110 in a matrix form. That is, the display panel 110 has a plurality of subpixel rows . . . , R(n+1), R(n+2), R(n+3), R(n+4), R(n+5), . . . . The display panel 110 has a plurality of subpixel columns.

The plurality of subpixel rows . . . , R(n+1), R(n+2), R(n+3), R(n+4), R(n+5), . . . may be sequentially scanned.

In the case where each subpixel SP has the 3T1C structure, a scan signal line SCL for transmitting scan signals SCAN and a sense signal line SENL for transmitting sense signals SENSE may be arranged in each of the plurality of subpixel rows . . . , R(n+1), R(n+2), R(n+3), R(n+4), R(n+5), . . . .

The display panel 110 may have a plurality of subpixel columns, and one data line DL may be disposed in each of the plurality of subpixel columns to correspond thereto. In some cases, each data line DL may be disposed for every two or three subpixel columns.

Like the subpixel driving operation described above, when the $(n+1)^{th}$ subpixel row R(n+1) among the plurality of subpixel rows . . . , R(n+1), R(n+2), R(n+3), R(n+4), R(n+5), . . . is driven, a scan signal SCAN and a sense signal SENSE are applied to the subpixels SP arranged in the $(n+1)^{th}$ subpixel row R(n+1), and image data voltages Vdata are supplied to the subpixels SP arranged in the $(n+1)^{th}$ subpixel row R(n+1) through the plurality of data lines DL.

Subsequently, the $(n+2)^{th}$ subpixel row R(n+2) positioned below the $(n+1)^{th}$ subpixel row R(n+1) is driven. A scan signal SCAN and a sense signal SENSE are applied to the subpixels SP arranged in the $(n+2)^{th}$ subpixel row R(n+2), and image data voltages Vdata are supplied to the subpixels SP arranged in the $(n+2)^{th}$ subpixel row R(n+2) through the plurality of data lines DL.

In this way, the image data write operation is performed on the plurality of subpixel rows . . . , R(n+1), R(n+2), R(n+3), R(n+4), R(n+5), . . . in sequence. The image data write operation is a procedure executed in an image data write step in the subpixel driving operation described above.

According to the subpixel driving operation described above, an image data write step, a boosting step, and an emission step may be sequentially performed on the plurality of subpixel rows . . . , R(n+1), R(n+2), R(n+3), R(n+4), R(n+5), . . . for one frame time.

Meanwhile, as shown in FIG. 4, the emission period EP according to the emission step of the subpixel driving operation on each of the plurality of subpixel rows, R(n+1), R(n+2), R(n+3), R(n+4), R(n+5), . . . does not last until the end within one frame time. Here, the emission period EP may be referred to as a "real image period".

Real display driving may be performed during a portion of one frame time, and fake display driving may be performed during the remaining portion thereof on each of the plurality of subpixel rows . . . , R(n+1), R(n+2), R(n+3), R(n+4), R(n+5), . . . .

During one frame time, one subpixel SP emits light through real display driving (the image data write step, the boosting step, and the emission step) during the emission period EP corresponding to a portion of one frame time, and then does not emit light through fake display driving during the remaining period thereof excluding the emission period EP of one frame time. The period in which the subpixel SP does not emit light in one frame time is referred to as a "non-emission period NEP".

The fake display driving is intended to display images (fake images), which is different from real display driving for displaying real images. The fake display driving may be performed by inserting fake images between real images. Therefore, the fake display driving is also called "fake data insertion (FDI) driving". Hereinafter, the fake display driving will be described as "fake data insertion driving".

During the real display driving, image data voltages Vdata corresponding to real images are supplied to the subpixels SP in order to display real images. On the other hand, during the fake data insertion driving, a fake data voltage Vfake corresponding to a fake image, which has no relation to the real image, is supplied to one or more subpixels SP.

That is, the image data voltages Vdata supplied to the subpixels SP during the normal real display driving may be variable depending on the frame or the images, whereas the fake data voltage Vfake supplied to one or more subpixels SP during the fake data insertion driving may be constant without varying depending on the frame or the images.

As a method of the fake data insertion driving described above, the fake data insertion driving is performed on one subpixel row, and may then be performed on one subsequent subpixel row.

Alternatively, as another method of the fake data insertion driving described above, the fake data insertion driving may be simultaneously performed on a plurality of subpixel rows, and may then be performed on a plurality of subsequent subpixel rows. That is, the fake data insertion driving may be simultaneously executed in units of a plurality of subpixel rows. For example, the number (k) of subpixel rows on which the fake data insertion driving is simultaneously performed may be 2, 4, 8, or the like.

Referring to FIGS. 4 to 6, after a real image data write operation is sequentially performed on the subpixel row R(n+1), the subpixel row R(n+2), the subpixel row R(n+3), and the subpixel row R(n+4), a fake data write operation may be simultaneously performed on k subpixel rows disposed before the subpixel row R(n+1) and in which a predetermined emission period EP has elapsed.

Subsequently, after a real image data write operation is sequentially performed on the subpixel row R(n+5), the subpixel row R(n+6), the subpixel row R(n+7), and the subpixel row R(n+8), a fake data write operation may be simultaneously performed on k subpixel rows disposed before the subpixel row R(n+1) or the subpixel row R(n+5) and in which a predetermined emission period EP has elapsed.

The numbers (k) of subpixel rows on which the fake data insertion driving is simultaneously performed may be equal or different. For example, the fake data insertion driving may be simultaneously performed on the first two subpixel rows, and may then be simultaneously performed in units of four subpixel rows. As another example, the fake data insertion driving may be simultaneously performed on the first four subpixel rows, and may then be simultaneously performed in units of eight subpixel rows.

By displaying real image data and fake data in the same frame through the fake data insertion driving described above, it is possible to prevent a motion blur phenomenon in which images are not distinct and images are dragged, thereby improving the image quality.

During the fake data insertion driving described above, a real image data write operation and a fake data write operation may be performed through the data line DL.

In addition, the fake data write operation may be simultaneously performed on a plurality of subpixel rows as described above, thereby compensating for the difference in brightness due to the difference in the emission period EP between the positions of the subpixel rows and securing the image data write time.

Meanwhile, it is possible to adaptively adjust the length of the emission period EP depending on images by adjusting the timing of the fake data insertion driving.

The image data write timing and the fake data write timing may be varied through the control of the gate driving.

For example, the fake data voltage Vfake may be a black data voltage Vblk or a low-grayscale data voltage.

If the fake data voltage Vfake is a black data voltage Vblk, the fake data insertion driving may also be referred to as "black data insertion (BDI) driving". In the case of fake data insertion driving, the fake data write may be referred to as "black data write".

The period in which k subpixel rows do not emit light due to the fake data insertion driving may be referred to as a "non-emission period NEP" or a "black image period".

Meanwhile, the gate driving may be sequentially performed on the respective ones of the plurality of subpixel rows . . . , R(n+1), R(n+2), R(n+3), R(n+4), R(n+5), . . . while overlapping for a predetermined period of time.

Referring to FIG. 6, in overlap driving, the scan transistor SCT and the sense transistor SENT included in each of the plurality subpixel rows . . . , R(n+1), R(n+2), R(n+3), R(n+4), R(n+5), . . . may be turned on and off at the same time. That is, in overlap driving, a scan signal SCAN and a sense signal SENSE applied to the scan transistor SCT and the sense transistor SENT, respectively, included in each of the plurality of subpixel rows . . . , R(n+1), R(n+2), R(n+3), R(n+4), R(n+5), . . . may be the same gate signal having an interval of a turn-on level voltage at the same timing.

According to the examples in FIGS. 5 and 6, the lengths of intervals of a turn-on level voltage of the gate signals SCAN and SENSE supplied to each of the plurality of subpixel rows . . . , R(n+1), R(n+2), R(n+3), R(n+4), R(n+5), . . . may be, for example, 2H.

According to the examples in FIGS. 5 and 6, the intervals of a turn-on level voltage of two gate signals SCAN and SENSE supplied to each of the plurality of subpixel rows . . . , R(n+1), R(n+2), R(n+3), R(n+4), R(n+5), . . . may overlap each other.

The lengths of intervals of a turn-on level voltage of the gate signals SCAN and SENSE supplied to each of the plurality of subpixel rows . . . , R(n+1), R(n+2), R(n+3), R(n+4), R(n+5), . . . may all be 2H.

The intervals (2H) of a turn-on level voltage of the scan signals SCAN and the sense signals SENSE applied to the scan transistors SCT and the sense transistors SENT of the subpixels SP, respectively, arranged in the subpixel row R(n+1) may overlap the intervals (2H) of a turn-on level voltage of the scan signals SCAN and the sense signals SENSE applied to the scan transistors SCT and the sense transistors SENT of the subpixels SP, respectively, arranged in the subpixel row R(n+2) by 1H.

The intervals (2H) of a turn-on level voltage of the scan signals SCAN and the sense signals SENSE applied to the scan transistors SCT and the sense transistors SENT of the subpixels SP, respectively, arranged in the subpixel row R(n+2) may overlap the intervals (2H) of a turn-on level voltage of the scan signals SCAN and the sense signals SENSE applied to the scan transistors SCT and the sense transistors SENT of the subpixels SP, respectively, arranged in the subpixel row R(n+3) by 1H.

The intervals (2H) of a turn-on level voltage of the scan signals SCAN and the sense signals SENSE applied to the scan transistors SCT and the sense transistors SENT of the subpixels SP, respectively, arranged in the subpixel row R(n+3) may overlap the intervals (2H) of a turn-on level voltage of the scan signals SCAN and the sense signals SENSE applied to the scan transistors SCT and the sense transistors SENT of the subpixels SP, respectively, arranged in the subpixel row R(n+4) by 1H.

According to the examples in FIGS. 5 and 6, the intervals of a turn-on level voltage of two gate signals SCAN and SENSE in each subpixel row may be 2H, and the intervals of a turn-on level voltage of two gate signals SCAN and SENSE of two adjacent subpixel rows may overlap each other by 1H.

The above gate driving method is referred to as "overlap driving", and if the intervals of a turn-on level voltage of two gate signals SCAN and SENSE in each subpixel row is 2H as shown in FIGS. 5 and 6, it may also be referred to as "2H overlap driving".

The overlap driving may be modified in any of various ways in addition to the 2H overlap driving.

As another example of the overlap driving, the intervals of a turn-on level voltage of two gate signals SCAN and SENSE in each subpixel row may be 3H, and the intervals of a turn-on level voltage of two gate signals SCAN and SENSE in two adjacent subpixel rows may overlap each other by 2H.

As another example of the overlap driving, the intervals of a turn-on level voltage of two gate signals SCAN and SENSE in each subpixel row may be 3H, and the intervals of a turn-on level voltage of two gate signals SCAN and SENSE in two adjacent subpixel rows may overlap each other by 1H.

As another example of the overlap driving, the intervals of a turn-on level voltage of two gate signals SCAN and SENSE in each subpixel row may be 4H, and the intervals of a turn-on level voltage of two gate signals SCAN and SENSE in two adjacent subpixel rows may overlap each other by 3H.

Although there may be a variety of overlap driving as described above, hereinafter, for the convenience of describing, 2H overlap driving will be described as an example.

During the 2H overlap driving described above, the front part (having a length of 1H) of the interval (having a length of 2H) of a turn-on level voltage of two gate signals SCAN and SENSE in each of the subpixel rows . . . , R(n+1), R(n+2), R(n+3), R(n+4), R(n+5), . . . is a gate signal part for pre-charge (PC) driving in which a data voltage (this serves as a pre-charge data voltage) is applied to a corresponding subpixel. The rear part (having a length of 1H) of the interval of a turn-on level voltage of two gate signals SCAN and SENSE in each subpixel row is a gate signal part that enables an image data write operation in which a real image data voltage Vdata is applied to a corresponding subpixel.

Through the overlap driving described above, it is possible to improve a charging rate in each subpixel, thereby improving the image quality.

If both the fake data insertion driving and the overlap driving described above are performed, the interval of a turn-on level voltage of two gate signals SCAN and SENSE in the subpixel row R(n+3) overlaps the interval of a turn-on level voltage of two gate signals SCAN and SENSE in the subpixel row R(n+4).

In this case, the rear part having 1H of the interval of a turn-on level voltage of two gate signals SCAN and SENSE in the subpixel row R(n+3) overlaps the interval of a turn-on level voltage of two gate signals SCAN and SENSE in the subsequent subpixel row R(n+4), in which an image data write operation is performed on the subpixel row R(n+3). The front part having 1H of the interval of a turn-on level voltage of two gate signals SCAN and SENSE in the subpixel row R(n+4) corresponds to a pre-charge driving period. In addition, an image data write operation is performed on the subpixel rows R(n+3) and the subpixel rows R(n+4) before the fake data insertion driving is performed.

In addition, the interval of a turn-on level voltage of two gate signals SCAN and SENSE in the subpixel row R(n+5) overlaps the interval of a turn-on level voltage of two gate signals SCAN and SENSE in the subpixel row R(n+6).

In this case, the rear part having 1H of the interval of a turn-on level voltage of two gate signals SCAN and SENSE in the subpixel row R(n+5) overlaps the interval of a turn-on level voltage of two gate signals SCAN and SENSE in the subsequent subpixel row R(n+6), in which an image data write operation is performed on the subpixel row R(n+5). The front part having 1H of the interval of a turn-on level voltage of two gate signals SCAN and SENSE in the subpixel row R(n+6) corresponds to a pre-charge driving period. In addition, the an image data write operation is performed on the subpixel row R(n+5) and the subpixel row R(n+6) before the fake data insertion driving is performed.

However, the interval of a turn-on level voltage of two gate signals SCAN and SENSE in the subpixel row R(n+4) does not overlap the interval of a turn-on level voltage of two gate signals SCAN and SENSE in the subsequent subpixel row R(n+5) immediately before the fake data insertion driving is performed.

The rear part having 1H of the interval of a turn-on level voltage of two gate signals SCAN and SENSE in the subpixel row R(n+4) corresponds to the period in which an image data write operation is performed on the subpixel row R(n+4).

During the rear part having 1H of the interval of a turn-on level voltage of two gate signals SCAN and SENSE in the subpixel row R(n+4), the pre-charge driving is not performed on the subsequent subpixel row R(n+5).

Based on the fake data insertion period, an image data write operation is performed on the subpixel row R(n+4) immediately before the fake data insertion driving, and an image data write operation is performed on the subpixel row R(n+5) right after the fake data insertion driving.

The interval of a turn-on level voltage of two gate signals SCAN and SENSE in the subpixel row R(n+4) and the interval of a turn-on level voltage of two gate signals SCAN and SENSE in the subsequent subpixel row R(n+5) are separated from each other by the period in which the fake data insertion driving is performed.

In FIGS. 5 and 6, the graph Vg shows voltages of the first nodes N1 of the driving transistors DT of the subpixels included in the subpixel rows, and shows changes in the voltage state before entering a boosting step in the subpixel driving operation.

Referring to FIGS. 5 and 6, the graph Vs shows the voltages of the second nodes N2 of the driving transistors DT of the subpixels included in the subpixel rows, and shows changes in the voltage state before entering a boosting step in the subpixel driving operation.

Referring to the graph Vg in FIGS. 5 and 6, the voltages Vg of the first nodes N1 of the driving transistors DT of the subpixels included in each subpixel row become image data voltages Vdata according to the image data write operation in the remaining period excluding the period in which the fake data insertion is performed.

However, during the period in which the fake data insertion is performed, the voltages Vg of the first nodes N1 of the driving transistors DT of the subpixels included in the subpixel rows, on which the fake data insertion driving is performed, become fake data voltages Vfake.

Meanwhile, as described above, the rear part period of the interval of a turn-on level voltage of two gate signals SCAN and SENSE in each of the subpixel rows R(n+1), R(n+2), and R(n+3) overlaps the front part period of the interval of a turn-on level voltage of two gate signals SCAN and SENSE in the subsequent subpixel row. However, the rear part period of the interval of a turn-on level voltage of two gate signals SCAN and SENSE in the subpixel row R(n+4) does not overlap the front part period of the interval of a turn-on level voltage of two gate signal SCAN and SENSE in the subsequent subpixel row R(n+5).

Therefore, during the interval of a turn-on level voltage of two gate signals SCAN and SENSE in each of the subpixel rows R(n+1), R(n+2), and R(n+3), the voltages Vs of the second nodes N2 of the driving transistors DI of subpixels included in each of the subpixel rows R(n+1), R(n+2), and R(n+3) become a voltage Vref+ΔV similar to a reference voltage Vref in the image data write step. At this time, the potential difference Vgs between the first node N1 and the second node N2 of each driving transistor DI is Vdata-(Vref+ΔV).

During the period of 1H immediately before the fake data insertion period, that is, during the rear part period of the interval of a turn-on level voltage of two gate signals SCAN and SENSE in the subpixel row R(n+4) {it does not overlap the front part period of the interval of a turn-on level voltage of two gate signal SCAN and SENSE in the subsequent subpixel row R(n+5)}, the voltages Vs of the second nodes N2 of the driving transistors DT of the subpixels included in the subpixel row R(n+4) may be a voltage Vref+Δ(V/2), which is lower than the voltage Vref+ΔV.

Accordingly, the potential difference Vgs {Vgs(4)} between the first node N1 and the second node N2 of each driving transistor DT is increased to Vdata-{Vref+Δ(V/2)} from the potential difference {Vdata-(Vref+ΔV)} in the previous period.

Figure 7:
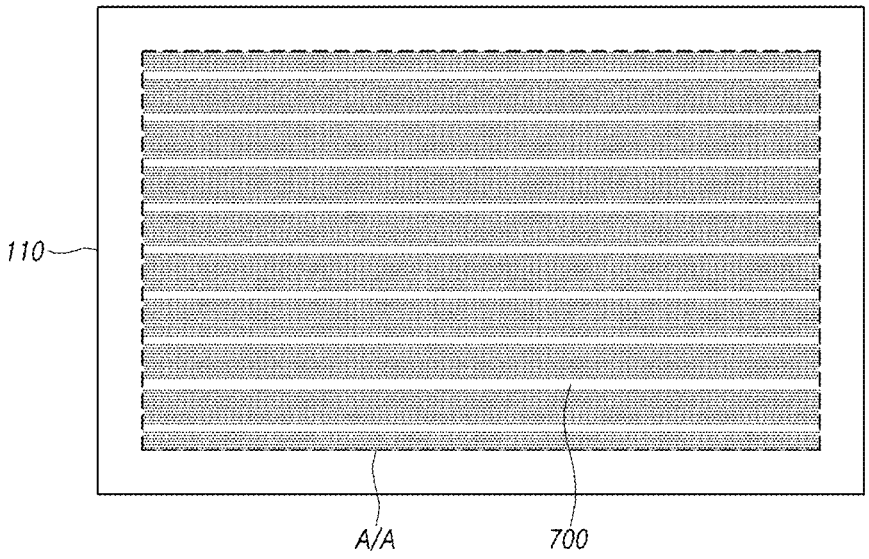
FIG. 7 is a diagram illustrating defects in brightness, which occur in specific lines, when a display device according to embodiments of the present disclosure performs fake data insertion driving and overlap driving.

FIG. 7 is a diagram illustrating defects in brightness, which occur in specific lines, when a display device 100 according to embodiments of the present disclosure performs fake data insertion driving and overlap driving.

As described above, when performing both overlap driving and fake data insertion driving, the potential difference Vgs between the first node N1 and the second node N2 of the driving transistor DT suddenly increases in the subpixel rows {e.g., R(n+4), R(n+8), etc.} in which the overlap driving cannot be performed immediately before the fake data insertion driving.

Therefore, as shown in FIG. 7, the subpixel rows {e.g., R(n+4), R(n+8), etc.} on which the image data write operation is performed immediately before the fake data insertion driving are viewed in the form of an abnormal bright line 700.

According to the embodiments of the present disclosure described above, even though a motion blur phenomenon is able to be prevented through the fake data insertion driving and a charging rate is able to be improved in each subpixel through the overlap driving, if both the fake data insertion driving and the overlap driving are performed, defects in brightness may be observed in specific lines due to unexpected side effects.

It was confirmed that the defects of brightness in specific lines result from the following substantial causes as a result of analysis thereof. The substantial causes of the defects of brightness in specific lines will be described with reference to FIG. 8.

Figure 8:
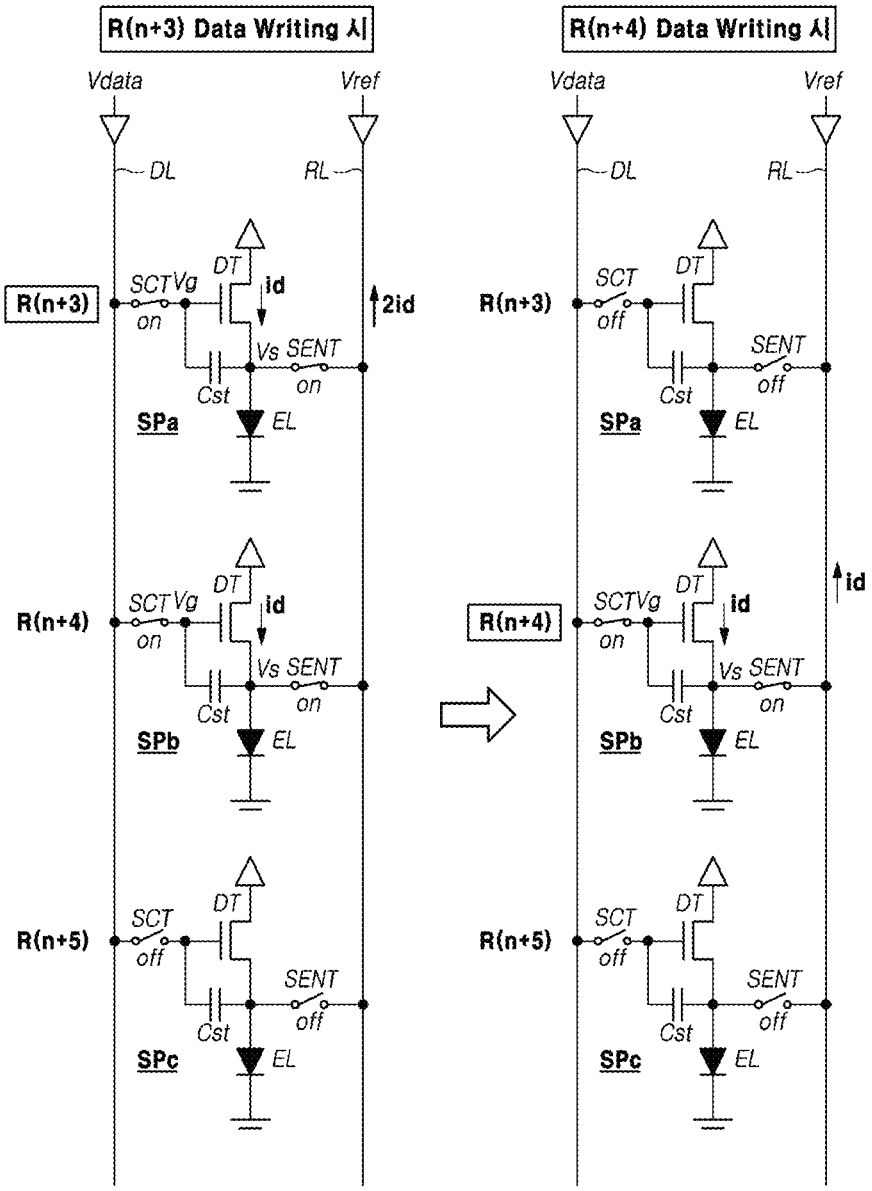
FIG. 8 is a diagram for explaining causes of defects in brightness, which occur in specific lines, when a display device according to embodiments of the present disclosure performs both fake data insertion driving and overlap driving.

FIG. 8 is a diagram for explaining causes of defects in brightness, which occur in specific lines, when a display device 100 according to embodiments of the present disclosure performs both fake data insertion driving and overlap driving.

FIG. 8 is a diagram illustrating the driving operation on a first subpixel Spa disposed in the subpixel row R(n+3), a second subpixel SPb disposed in the subpixel row R(n+4), and a third subpixel SPc disposed in the subpixel row R(n+5) in FIGS. 5 and 6.

Referring to FIG. 8, the first subpixel SPa disposed in the subpixel row R(n+3), the second subpixel SPb disposed in the subpixel row R(n+4), and the third subpixel SPc disposed in the subpixel row R(n+5) are arranged in the same column, and are electrically connected to the same data line DL and the same reference line RL.

That is, drain nodes or source nodes of scan transistors SCT disposed in the first subpixel SPa, the second subpixel SPb, and the third subpixel SPc may be electrically connected, in common, to the data line DL. Drain nodes or source nodes of sense transistors SENT disposed in the first subpixel SPa, the second subpixel SPb, and the third subpixel SPc may be electrically connected, in common, to the reference line RL.

Referring to FIGS. 5, 6, and 8, when an image data write operation is performed on the first subpixel SPa disposed in the subpixel row R(n+3), the scan transistor SCT included in the first subpixel SPa is turned on by a scan signal SCAN having a turn-on level voltage. Accordingly, the image data voltage Vdata supplied to the data line DL is transmitted to the first node N1 corresponding to the gate node of the driving transistor DI through the scan transistor SCT that is turned on.

At this time, the sense transistor SENT included in the first subpixel SPa is turned on by a sense signal SENSE having a turn-on level voltage along with the scan transistor SCT, so that the reference voltage Vref supplied to the reference line RL is transmitted to the second node N2 corresponding to the source node of the driving transistor DT through the sense transistor SENT that is turned on.

When an image data write operation is performed on the first subpixel SPa disposed in the subpixel row R(n+3) according to 2H overlap driving, a pre-charge driving may be performed on the second subpixel SPb disposed in the subsequent subpixel row R(n+4).

That is, when the image data write operation is performed on the first subpixel SPa disposed in the subpixel row R(n+3), a scan signal SCAN of a turn-on level voltage is applied to the second subpixel SPb disposed in the subsequent subpixel row R(n+4), and the image data voltage Vdata supplied to the data line DL is applied, as a pre-charge voltage, to the first node N1, which is a gate node of the driving transistor DT of the second subpixel SPb, through the scan transistor SCT that is turned on.

At this time, the sense transistor SENT included in the second subpixel SPb disposed in the subpixel row R(n+4) is turned on by the sense signal SENSE having a turn-on level voltage along with the scan transistor SCT, so that the reference voltage Vref supplied to the reference line RL is transmitted to the second turn N2 corresponding to the source node of the driving transistor DI through the sense transistor SENT that is turned on.

When an image data write operation is performed on the first subpixel SPa disposed in the subpixel row R(n+3), a combined current 2*id* of a current id supplied to the first subpixel SPa and a current id supplied to the second subpixel SPb flows through the reference line RL.

Accordingly, the line capacitor provided in the reference line RL may be charged by the current 2*id* flowing through the reference line RL, thereby increasing the voltage of the reference line RL. The increased voltage of the reference line RL may be transmitted to the second node N2 of the driving transistor DT in the first subpixel SPa through the sense transistor SENT that is turned on in the first subpixel SPa disposed in the subpixel row R(n+3), and at the same time, the increased voltage of the reference line RL may be transmitted to the second node N2 of the driving transistor DT in the second subpixel SPb through the sense transistor SENT that is turned on in the second subpixel SPb disposed in the subpixel row R(n+4).

Accordingly, the voltage Vs of the second node N2 of the driving transistor DT in the first subpixel SPa disposed in the subpixel row R(n+3), on which the image data write operation is performed, increases.

Meanwhile, after the image data write operation on the first subpixel SPa disposed in the subpixel row R(n+3), an image data write operation may be performed on the second subpixel SPb disposed in the subpixel row R(n+4).

When an image data write operation is performed on the second subpixel SPb disposed in the subpixel row R(n+4), the scan transistor SCT included in the second subpixel SPb disposed in the subpixel row R(n+4) is turned on by a scan signal SCAN having a turn-on level voltage. Accordingly, the image data voltage Vdata supplied to the data line DL is transmitted to the first node N1 corresponding to the gate node of the driving transistor DI through the scan transistor SCT that is turned on.

At this time, the sense transistor SENT included in the second subpixel SPb disposed in the subpixel row R(n+4) is turned on by a sense signal SENSE having a turn-on level voltage along with the scan transistor SCT, so that the reference voltage Vref supplied to the reference line RL is transmitted to the second node N2 corresponding to the source node of the driving transistor DT through the sense transistor SENT that is turned on.

A pre-charge driving is not performed on the third subpixel SPc disposed in the subsequent subpixel row R(n+5) while the image data write operation is performed on the second subpixel SPb disposed in the subpixel row R(n+4) because the period in which the image data write operation is performed on the second subpixel SPb disposed in the subpixel row R(n+4) corresponds to the period immediately before the fake data insertion driving is performed.

Accordingly, when the image data write operation is performed on the second subpixel SPb disposed in the subpixel row R(n+4), only the current id supplied from the second subpixel SPb flows through the reference line RL.

Accordingly, the voltage Vs of the second node N2 of the driving transistor DT in the second subpixel SPb disposed in the subpixel row R(n+4), on which the image data write operation is performed without overlap driving immediately before performing the fake data insertion driving, increases. However, the amount of increase in the voltage of the second node N2 of the driving transistor DT in the second subpixel SPb of the subpixel row R(n+4) without overlap driving immediately before the fake data insertion driving is smaller than the amount of increase in the voltage of the second node N2 of the driving transistor DT in the first subpixel SPa disposed in the subpixel row R(n+3), on which overlap driving is normally performed, due to the reduction in the amount of increase in the voltage of the reference line RL caused by the reduction in the current flowing through the reference line RL.

Accordingly, the potential difference between the first node N1 and the second node N2 of the driving transistor DT in the second subpixel SPb disposed in the subpixel row R(n+4) increases immediately before the fake data voltage Vfake is applied to the data line DL according to the fake data insertion driving (that is, immediately before the fake data insertion driving).

The above increase in the potential difference Vgs may cause bright lines 700 to be displayed in the subpixel rows {e.g., R(n+4), R(n+12), R(n+20), etc.} on which the image data write operation is performed immediately before the fake data insertion driving. An advanced overlap driving method for preventing this phenomenon will be described in detail below.

Hereinafter, in order to explain the advanced overlap driving method, an example in which subpixels SP and signal lines SCL, SENL, DL, and RL are arranged on the display panel 110 will be preferentially described.

Figure 9:
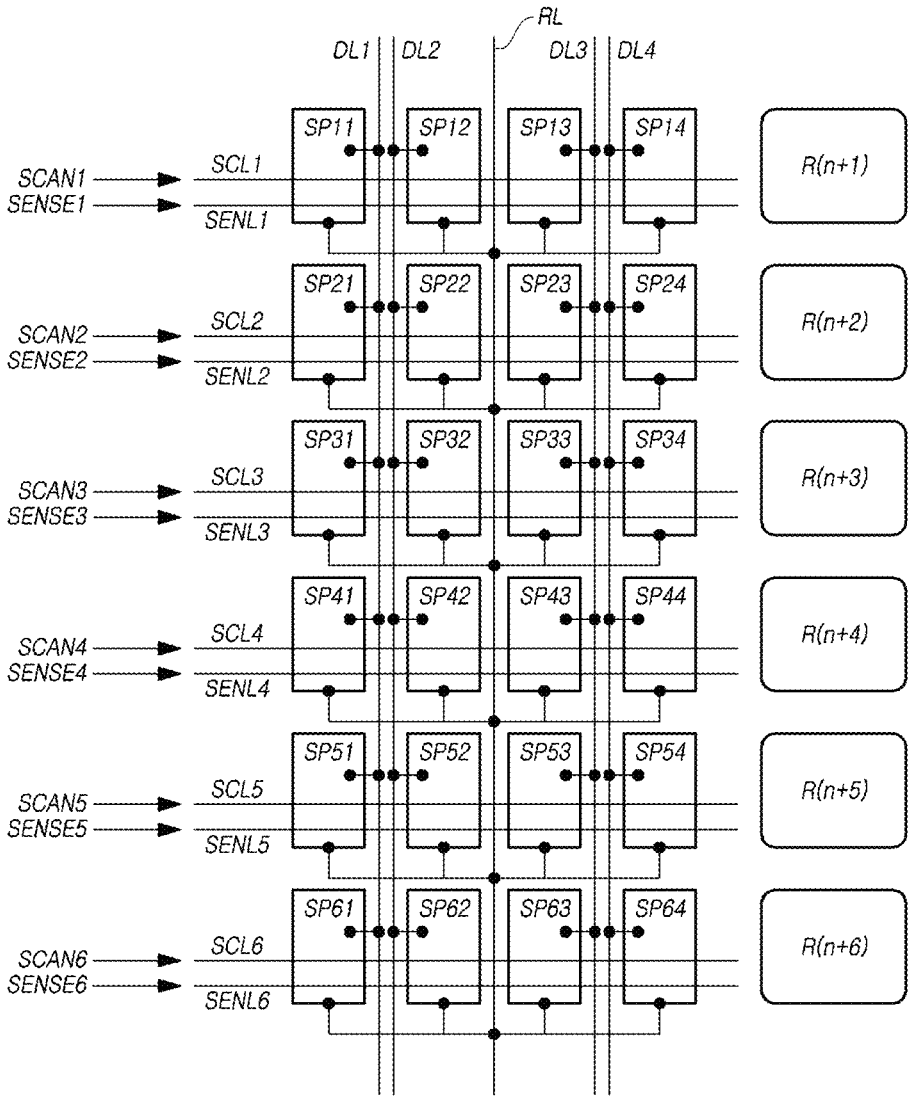
FIG. 9 is a diagram illustrating an example of subpixels and signal lines arranged on a display panel of a display device according to embodiments of the present disclosure.

FIG. 9 is a diagram illustrating an example of subpixels SPrc (r=1 to 6 and c=1 to 4) and signal lines SCLr, SENLr, DLc, and RL (r=1 to 6 and c=1 to 4) arranged on a display panel 110 of a display device 100 according to embodiments of the present disclosure.

Referring to FIG. 9, 24 subpixels SPrc (r=1 to 6 and c=1 to 4) may be arranged in 6 rows by 4 columns on the display panel 110. That is, 24 subpixels SPrc (r=1 to 6 and c=1 to 4) are arranged in six subpixel rows R(n+1), R(n+2), . . . , and R(n+6) on the display panel 110.

Referring to FIG. 9, six scan signal lines SCLr(r=1 to 6) may be arranged in the six subpixel rows R(n+1), R(n+2), . . . , and R(n+6) to correspond thereto. Six sense signal lines SENLr(r=1 to 6) may be arranged in the six subpixel rows R(n+1), R(n+2), . . . , and R(n+6) to correspond thereto.

The six scan signal lines SCLr (r=1 to 6) supply scan signals SCANr (r=1 to 6) to the six subpixel rows R(n+1), R(n+2), . . . , and R(n+6). The six sense signal lines SENLr (r=1 to 6) supply sense signals SENSEr (r=1 to 6) to the six subpixel rows R(n+1), R(n+2), . . . , and R(n+6).

According to the overlap driving described above with reference to FIGS. 5 and 6, two gate signals SCAN and SENSE supplied to the same subpixel row have the interval of a turn-on level voltage at the same timing.

For example, in the first subpixel row R(n+1), a first scan signal SCAN1 supplied to a first scan signal line SCL1 and a first sense signal SENSE1 supplied to a first sense signal line SENL1 have the interval of a turn-on level voltage at the same timing. In addition, in the second subpixel row R(n+2), a second scan signal SCAN2 supplied to a second scan signal line SCL2 and a second sense signal SENSE2 supplied to a second sense signal line SENL2 have the interval of a turn-on level voltage at the same timing. Further, in the third subpixel row R(n+3), a third scan signal SCAN3 supplied to a third scan signal line SCL3 and a third sense signal SENSE3 supplied to a third sense signal line SENL3 have the interval of a turn-on level voltage at the same timing.

According to the advanced overlap driving to be described later, two gate signals SCAN and SENSE supplied to the same subpixel row may have the interval of a turn-on level voltage at different timings.

Referring to FIG. 9, four data lines DLc (c=1 to 4) may be arranged in four subpixel columns, respectively.

Referring to FIG. 9, a single reference line RL may supply a reference voltage Vref to the subpixels arranged in the four subpixel columns. That is, the four subpixel columns may share one reference line RL.

The following description and drawings will be made based on or follow the arrangement of the subpixels SPrc (r=1 to 6 and c=1 to 4) and the signal lines SCLr, SENLr, DLc, and RL (r=1 to 6 and c=1 to 4) in FIG. 9.

Figure 10:
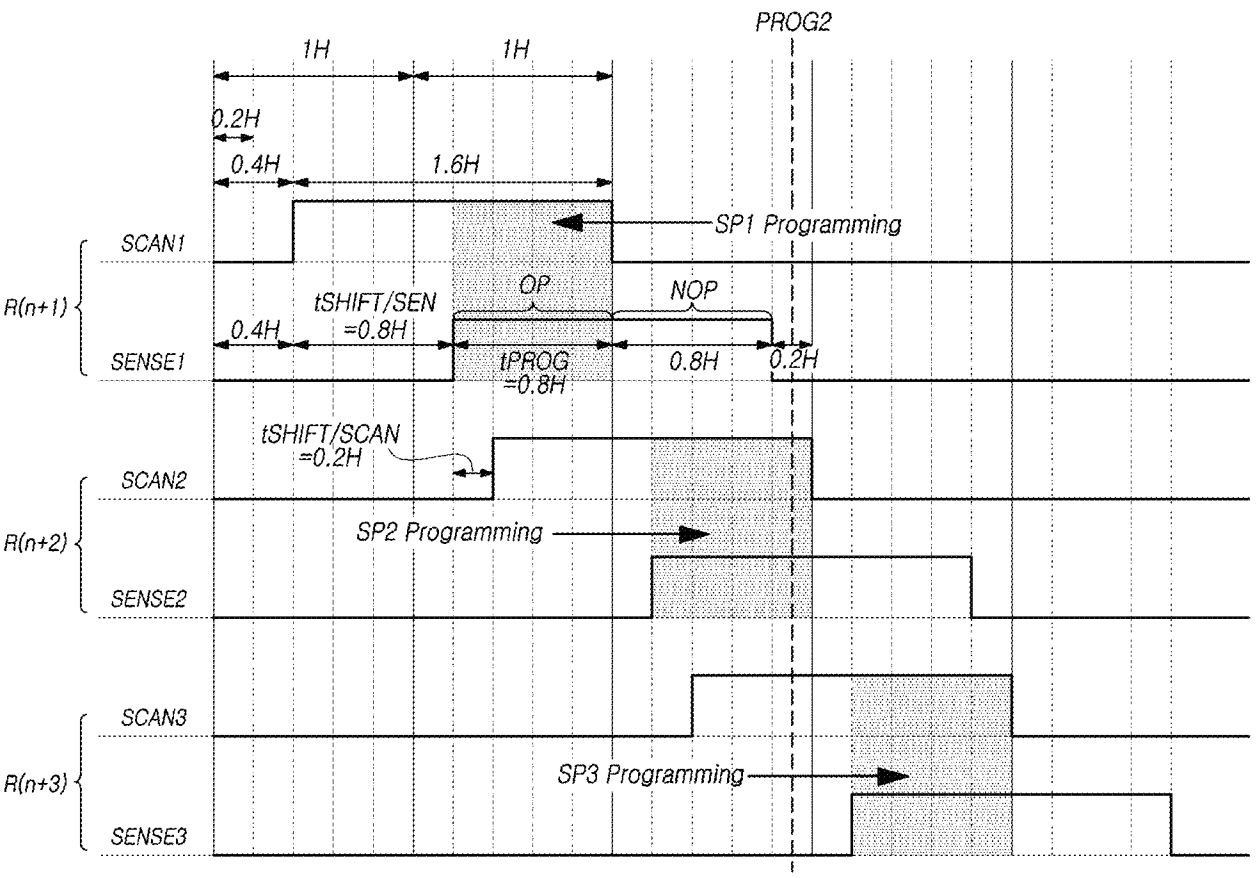
FIG. 10 is a driving timing diagram for advanced overlap driving of a display device according to embodiments of the present disclosure.

FIG. 10 is a driving timing diagram for advanced overlap driving of a display device 100 according to embodiments of the present disclosure.

Referring to FIG. 10, a plurality of subpixels SP may include a first subpixel SP1 connected to a first scan signal line SCL1 for transmitting a first scan signal SCAN1 and a first sense signal line SENL1 for transmitting a first sense signal SENSE1, a second subpixel SP2 connected to a second scan signal line SCL2 for transmitting a second scan signal SCAN2 and a second sense signal line SENL2 for transmitting a second sense signal SENSE2, a third subpixel SP3 connected to a third scan signal line SCL3 for transmitting a third scan signal SCAN3 and a third sense signal line SENL3 for transmitting a third sense signal SENSE3, and the like.

In FIG. 10, the first subpixel SP1 represents the subpixels SPrc (r=1 and c=1 to 4) arranged in the first subpixel row R(n+1) in FIG. 9. In FIG. 10, the second subpixel SP2 represents the subpixels SPrc (r=2 and c=1 to 4) arranged in the second subpixel row R(n+2) in FIG. 9. In FIG. 10, the third subpixel SP3 represents the subpixels SPrc (r=3 and c=1 to 4) arranged in the third subpixel row R(n+3) in FIG. 9.

According to this, the first subpixel SP1, the second subpixel SP2, and the third subpixel SP3 are sequentially arranged in a column direction.

Referring to FIG. 10, a plurality of scan signal lines SCL may include a first scan signal line SCL1, a second scan signal line SCL2, and a third scan signal line SCL3 that correspond to the first subpixel SP1, the second subpixel SP2, and the third subpixel SP3, respectively, which are sequentially arranged on the display panel 110.

Referring to FIG. 10, a plurality of sense signal lines SENL may include a first sense signal line SENL1, a second sense signal line SENL2, and a third sense signal line SENL3 that correspond to the first subpixel SP1, the second subpixel SP2, and the third subpixel SP3, respectively, which are sequentially arranged on the display panel 110.

The drain nodes (or the source nodes) of the sense transistors SENT included in the first subpixel SP1, the second subpixel SP2, and the third subpixel SP3 may be electrically connected to the same reference line RL.

Referring to FIG. 10, the display device 100 according to embodiments of the present disclosure may perform an advanced overlap driving to control the timing of the driving period of each of two adjacent subpixel rows, thereby controlling the timing or patterns in which the driving periods of two adjacent subpixel rows overlap each other.

Referring to FIG. 10, the display device 100 according to embodiments of the present disclosure performs an advanced overlap driving, thereby controlling the timing of the interval of a turn-on level voltage of each of the scan signal SCAN and the sense signal SENSE, which are two gate signals supplied to one subpixel row.

Referring to FIG. 10, according to the advanced overlap driving, two gate signals SCAN and SENSE supplied to the same subpixel row may have the intervals of a turn-on level voltage at different timings from each other.

For example, during the advanced overlap driving, in relation to the first subpixel row R(n+1), the first scan signal SCAN1 supplied to the first scan signal line SCL1 and the first sense signal SENSE1 supplied to the first sense signal line SENL1 do not have the interval of a turn-on level voltage at the same timing.

In addition, during the advanced overlap driving, in relation to the second subpixel row R(n+2), the second scan signal SCAN2 supplied to the second scan signal line SCL2 and the second sense signal SENSE2 supplied to the second sense signal line SENL2 do not have the interval of a turn-on level voltage at the same timing.

In addition, during the advanced overlap driving, in relation to the third subpixel row R(n+3), the third scan signal SCAN3 supplied to the third scan signal line SCL3 and the third sense signal SENSE3 that is supplied to the third sense signal line SENL3 do not have the interval of a turn-on level voltage at the same timing.

Hereinafter, features of the scan signals SCAN1, SCAN2, and SCAN3 and the sense signals SENSE1, SENSE2, and SENSE3 for advanced overlap driving will be described in detail.

Referring to FIG. 10, in the display device 100 according to embodiments of the present disclosure, a first gate driving circuit 130 sequentially supplies the scan signals SCAN1, SCAN2, and SCAN3 having intervals of a turn-on level voltage to a plurality of scan signal lines SCL1, SCL2, and SCL3 arranged on the display panel 110.

In the case where the scan transistors SCT are n-type transistors (transistors having an n-type channel), as shown in FIG. 10, the intervals of a turn-on level voltage of the scan signals SCAN1, SCAN2, and SCAN3 may be intervals of a high level voltage, and the intervals of a turn-off level voltage of the scan signals SCAN1, SCAN2, and SCAN3 may be intervals of a low level voltage.

In the case where the scan transistors SCT are p-type transistors (transistors having a p-type channel), the intervals of a turn-on level voltage of the scan signals SCAN1, SCAN2, and SCAN3 may be intervals of a low level voltage, and the intervals of a turn-off level voltage of the scan signals SCAN1, SCAN2, and SCAN3 may be intervals of a high level voltage.

Referring to FIG. 10, in the display device 100 according to embodiments of the present disclosure, the second gate driving circuit 140 sequentially supplies sense signals SENSE1, SENSE2, and SENSE3 having an interval of a turn-on level voltage to a plurality of sense signal lines SENL1, SENL2, and SENL3 arranged on the display panel 110.

In the case where the sense transistors SENT are n-type transistors (transistors having an n-type channel), as shown in FIG. 10, the intervals of a turn-on level voltage of the sense signals SENSE1, SENSE2, and SENSE3 may be intervals of a high level voltage, and the intervals of a turn-off level voltage of the sense signals SENSE1, SENSE2, and SENSE3 may be intervals of a low level voltage.

In the case where the sense transistors SENT are p-type transistors (transistors having a p-type channel), the intervals of a turn-on level voltage of the sense signals SENSE1, SENSE2, and SENSE3 may be intervals of a low level voltage, and the intervals of a turn-off level voltage of the sense signals SENSE1, SENSE2, and SENSE3 may be intervals of a high level voltage.

Referring to FIG. 10, the first gate driving circuit 130 of the display device 100 according to embodiments of the present disclosure may supply a first scan signal SCAN1 having an interval of a turn-on level voltage to the first scan signal line SCL1 that is electrically connected to the gate node of the scan transistor SCT in the first subpixel SP1 included in the plurality of subpixels SP.

Referring to FIG. 10, the second gate driving circuit 140 of the display device 100 according to embodiments of the present disclosure may supply a first sense signal SENSE1 having an interval of a turn-on level voltage, which is delayed from the interval of a turn-on level voltage of the first scan signal SCAN1 by a predetermined sense shift time tSHIFT/SEN, to the first sense signal line SENL1 that is electrically connected to the gate node of the sense transistor SENT in the first subpixel SP1.

The timing of the interval of a turn-on level voltage of the first sense signal SENSE1 may be delayed from the interval of a turn-on level voltage of the first scan signal SCAN1 by a predetermined sense shift time tSHIFT/SEN.

The first scan signal SCAN1 has a turn-on level voltage in advance, and thus, the scan transistor SCT is sufficiently turned on so that the programming for the image data voltage Vdata is performed. In addition, despite the delay of the interval of a turn-on level voltage of the first sense signal SENSE1, the sense transistor SENT may increase a charging speed through control of driving timing and expansion of channels of the sense transistor SENT. Thereby, the charging performance is able to be improved.

Referring to FIG. 10, the interval of a turn-on level voltage of the first sense signal SENSE1 may include a period OP in which the interval of a turn-on level voltage of the first sense signal SENSE1 overlaps the interval of a turn-on level voltage of the first scan signal SCAN1 and a period NOP in which the interval of a turn-on level voltage of the first sense signal SENSE1 does not overlap the interval of a turn-on level voltage of the first scan signal SCAN1.

Referring to FIG. 10, the period in which the interval of a turn-on level voltage of the first sense signal SENSE1 overlaps the interval of a turn-on level voltage of the first scan signal SCAN1 may correspond to the time during which the first subpixel SP1 is programmed. "Programming" the first subpixel SP1 may mean that corresponding image data is programmed onto the first subpixel SP1, and may mean that the capacitor Cst in the first subpixel SP1 is charged to a desired value by the image data voltage Vdata.

The period in which the interval of a turn-on level voltage of the first sense signal SENSE1 overlaps the interval of a turn-on level voltage of the first scan signal SCAN1 may correspond to a programming period tPROG in which image data is programmed onto the first subpixel SP1.

Referring to FIG. 10, the start point of the interval of a turn-on level voltage of the first sense signal SENSE1 may be delayed from the start point of the interval of a turn-on level voltage of the first scan signal SCAN1 by a sense shift time tSHIFT/SEN.

For example, the predetermined sense shift time tSHIFT/SEN may correspond to ½ of the interval of a turn-on level voltage of the first scan signal SCAN1.

Referring to FIG. 10, for example, the interval of a turn-on level voltage of the first sense signal SENSE1 and the interval of a turn-on level voltage of the first scan signal SCAN1 have the same time length.

Accordingly, the predetermined sense shift time tSHIFT/SEN may correspond to ½ of the interval of a turn-on level voltage of the first sense signal SENSE1.

In this case, the period in which the interval of a turn-on level voltage of the first sense signal SENSE1 overlaps the interval of a turn-on level voltage of the first scan signal SCAN1 may be equal to the sense shift time tSHIFT/SEN.

The programming period tPROG of the first subpixel SP1 may be equal to the sense shift time tSHIFT/SEN.

Referring to FIG. 10, the relationship between the second scan signal SCAN2 and the second sense signal SENSE2 and the features thereof are the same as the relationship between the first scan signal SCAN1 and the first sense signal SENSE1 and the features thereof described above. The relationship between the third scan signal SCAN3 and the third sense signal SENSE3 and the features thereof are the same as the relationship between the first scan signal SCAN1 and the first sense signal SENSE1 and the features thereof described above.

Referring to FIG. 10, there may be a timing PROG2 in which a sense transistor SENT in the first subpixel SP1 and a sense transistor SENT in the third subpixel SP3 are simultaneously turned off while the second scan signal SCAN2 having a turn-on level voltage is supplied to the gate node of the scan transistor SCT in the second subpixel SP2 and while the second sense signal SENSE2 having a turn-on level voltage is supplied to the gate node of the sense transistor SENT in the second subpixel SP2.

In other words, there may be a timing PROG2 in which a sense transistor SENT in the first subpixel SP1 and a sense transistor SENT in the third subpixel SP3 are simultaneously turned off during the period in which the interval of a turn-on level voltage of the second scan signal SCAN2 overlaps the interval of a turn-on level voltage of the second sense signal SENSE2.

Referring to FIG. 10, the interval of a turn-on level voltage of the first sense signal SENSE1 may be delayed from the interval of a turn-on level voltage of the first scan signal SCAN1 by a sense shift time tSHIFT/SEN. The interval of a turn-on level voltage of the first sense signal SENSE1 may overlap the interval of a turn-on level voltage of the first scan signal SCAN1 by a predetermined programming period tPROG.

Referring to FIG. 10, the interval of a turn-on level voltage of the second sense signal SENSE2 may be delayed from the interval of a turn-on level voltage of the second scan signal SCAN2 by a sense shift time tSHIFT/SEN. The interval of a turn-on level voltage of the second sense signal SENSE2 may overlap the interval of a turn-on level voltage of the second scan signal SCAN2 by a programming period tPROG.

Referring to FIG. 10, the interval of a turn-on level voltage of the second scan signal SCAN2 may overlap the interval of a turn-on level voltage of the first scan signal SCAN1. The interval of a turn-on level voltage of the second scan signal SCAN2 may be delayed from the interval of a turn-on level voltage of the first sense signal SENSE1 by a predetermined scan shift time tSHIFT/SCAN.

Referring to FIG. 10, the interval of a turn-on level voltage of the second sense signal SENSE2 may not overlap the interval of a turn-on level voltage of the first scan signal SCAN1.

Referring to FIG. 10, the third sense signal SENSE3 may have a turn-off level voltage during the period in which the interval of a turn-on level voltage of the second scan signal SCAN2 overlaps the interval of a turn-on level voltage of the second sense signal SENSE2.

The third sense signal SENSE3 may have a turn-off level voltage during the programming period tPROG of the second subpixel SP2.

The first sense signal SENSE1 may switch from a turn-on level voltage to a turn-off level voltage before the period in which the interval of a turn-on level voltage of the second scan signal SCAN2 overlaps the interval of a turn-on level voltage of the second sense signal SENSE2 ends.

According to the above description, both the first sense signal SENSE1 and the third sense signal SENSE3 may have a turn-off level voltage at a certain point PROG2 in the period in which the interval of a turn-on level voltage of the second scan signal SCAN2 overlaps the interval of a turn-on level voltage of the second sense signal SENSE2 (i.e., the programming period tPROG of the second subpixel SP2).

That is, both the sense transistor SENT in the first subpixel SP1 and the sense transistor SENT in the third subpixel SP3 may be in a turn-off state at a certain point PROG2 in the period in which the interval of a turn-on level voltage of the second scan signal SCAN2 overlaps the interval of a turn-on level voltage of the second sense signal SENSE2 (i.e., the programming period tPROG of the second subpixel SP2).

Accordingly, in the case where the second subpixel SP2 is the target on which the programming is to be performed, the second node N2 of the driving transistor DT and the reference line RL are electrically connected to each other by the sense transistor SENT that is turned on in the second subpixel SP2 on which the programming is being performed, among the first to third subpixels SP1, SP2, and SP3.

At this time, since the sense transistor SENT in the first subpixel SP1 positioned near the second subpixel SP2 on which the prograrnning is being performed, among the first to third subpixels SP1, SP2, and SP3, is in a turn-off state, the second node N2 of the driving transistor DT and the reference line RL are not electrically connected to each other. Likewise, since the sense transistor SENT in the third subpixel SP3 positioned near the second subpixel SP2 on which the programming is being performed, among the first to third subpixels SP1, SP2, and SP3, is in a turn-off state, the second node N2 of the driving transistor DT and the reference line RL are not electrically connected to each other.

The rear part of the interval of a turn-on level voltage of the first scan signal SCAN1 overlaps the front part of the interval of a turn-on level voltage of the second scan signal SCAN2.

The rear part of the interval of a turn-on level voltage of the first sense signal SENSE1 overlaps the front part of the interval of a turn-on level voltage of the second sense signal SENSE2.

The interval of a turn-on level voltage of the first sense signal SENSE1 and the interval of a turn-on level voltage of the second scan signal SCAN2 overlap each other to a large extent.

According to the example in FIG. 10, 1H corresponds to one horizontal time. The interval of a turn-on level voltage of the first, second, and third scan signal SCAN1, SCAN2, or SCAN3 is 1.6H. The interval of a turn-on level voltage of the first, second, or third sense signal SENSE1, SENSE2, or SENSE3 is 1.6H.

The predetermined sense shift time tSHIFT/SEN is 0.8H. The interval of a turn-on level voltage of the first sense signal SENSE1 starts while being delayed from the interval of a turn-on level voltage of the first scan signal SCAN1 by 0.8H corresponding to the sense shift time tSHIFT/SEN.

The period in which the interval of a turn-on level voltage of the first scan signal SCAN1 overlaps the interval of a turn-on level voltage of the first sense signal SENSE1 is 0.8H. The programming period tPROG of the first subpixel SP1 is 0.8H.

The interval of a turn-on level voltage of the second sense signal SENSE2 starts while being delayed from the interval of a turn-on level voltage of the second scan signal SCAN2 by 0.8H corresponding to the sense shift time tSHIFT/SEN.

The period in which the interval of a turn-on level voltage of the second scan signal SCAN2 overlaps the interval of a turn-on level voltage of the second sense signal SENSE2 is 0.8H. The programming period tPROG of the second subpixel SP2 is 0.8H.

The interval of a turn-on level voltage of the third sense signal SENSE3 starts while being delayed from the interval of a turn-on level voltage of the third scan signal SCAN3 by 0.8H corresponding to the sense shift time tSHIFT/SEN.

The period in which the interval of a turn-on level voltage of the third scan signal SCAN3 overaps the interval of a turn-on level voltage of the third sense signal SENSE3 is 0.8H. The programming period tPROG of the third subpixel SP3 is 0.8H.

The predetermined scan shift time tSHIFT/SCAN is 0.2H. The interval of a turn-on level voltage of the second scan signal SCAN2 is delayed from the interval of a turn-on level voltage of the first sense signal SENSE1 by 0.2H corresponding to the predetermined scan shift time tSHIFT/SCAN.

The interval of a turn-on level voltage of the first scan signal SCAN1 overlaps the interval of a turn-on level voltage of the second scan signal SCAN2 by 0.6H. The interval of a turn-on level voltage of the first sense signal SENSE1 overlaps the interval of a turn-on level voltage of the second sense signal SENSE2 by 0.6H.

When the interval of a turn-on level voltage of the first sense signal SENSE1 is 1.6H and when the interval of a turn-on level voltage of the second scan signal SCAN2 is 1.6H, the period in which the interval of a turn-on level voltage of the first sense signal SENSE1 overlaps the interval of a turn-on level voltage of the second scan signal SCAN2 is 1.4H. Accordingly, the period (1.4H) in which the interval of a turn-on level voltage of the first sense signal SENSE1 overlaps the interval of a turn-on level voltage of the second scan signal SCAN2 airmounts to 87.5% (=1.4/1.6) of the total period of each interval (1.6H).

Figure 11:
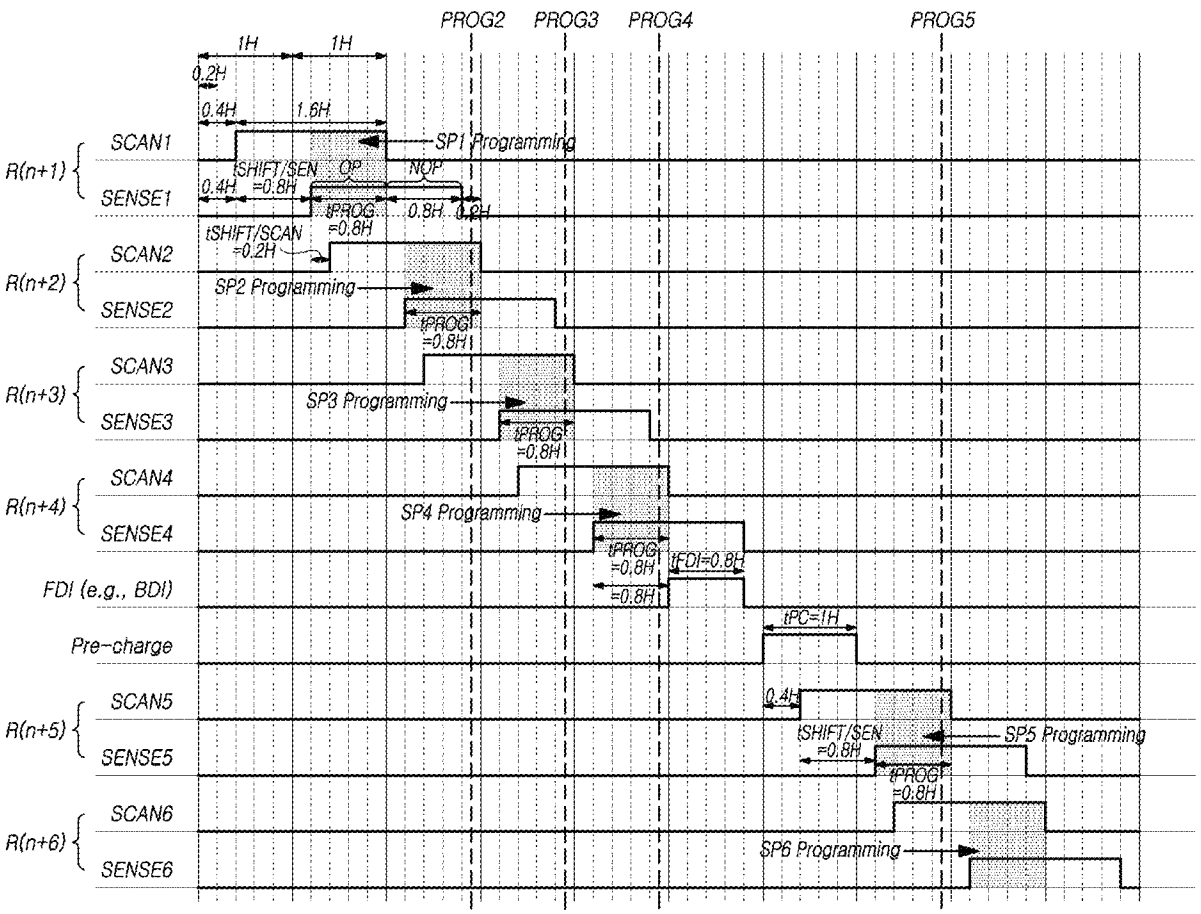
FIG. 11 is a driving timing diagram in the case where a display device according to embodiments of the present disclosure performs black data insertion driving and advanced overlap driving.
Figure 12:
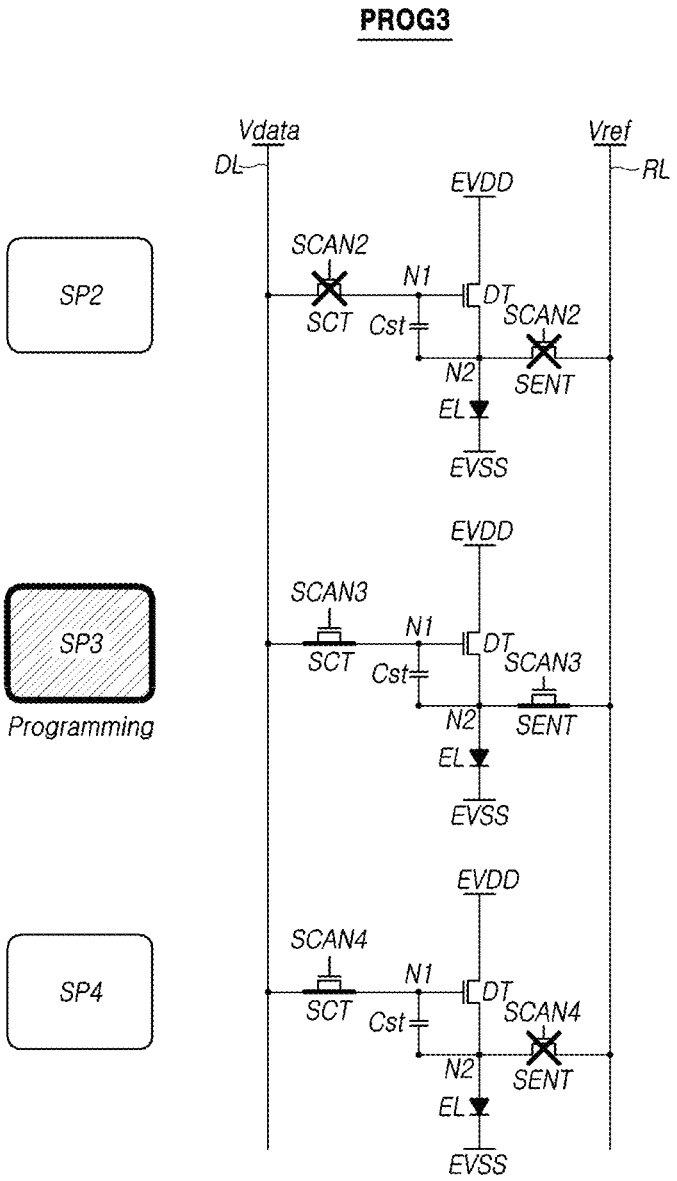
FIG. 12 is a diagram illustrating states of a third subpixel and subpixels adjacent thereto at programming timing of a third subpixel.
Figure 13:
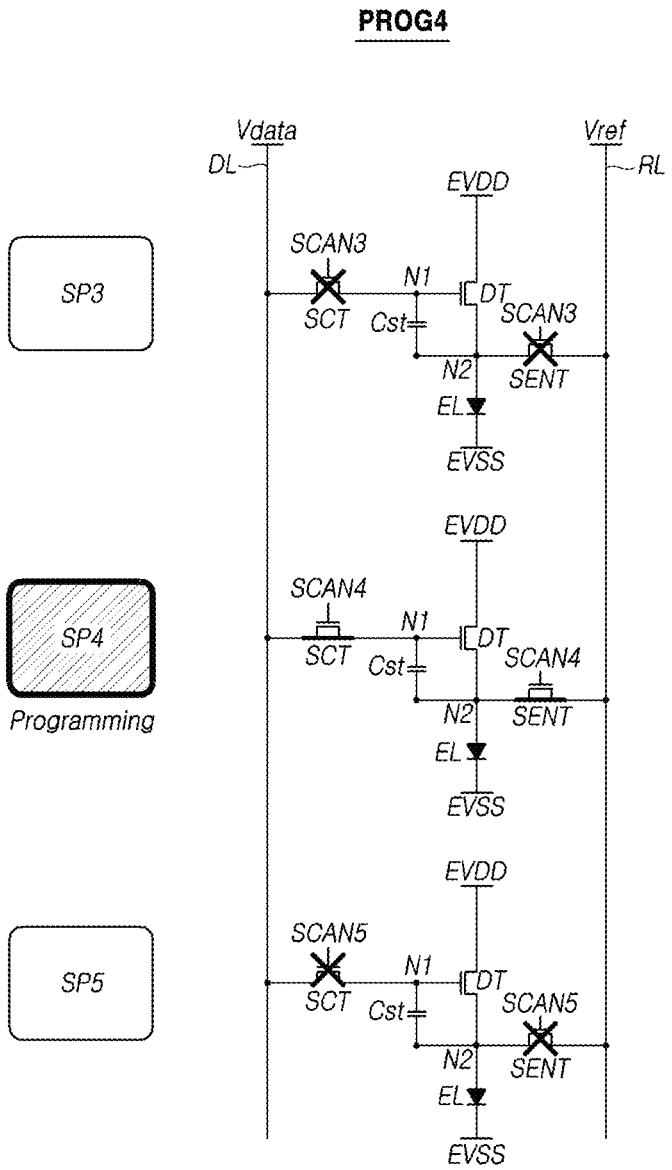
FIG. 13 is a diagram illustrating the states of a fourth subpixel and subpixels adjacent thereto at programming timing of the fourth subpixel before starting black data insertion driving.
Figure 14:
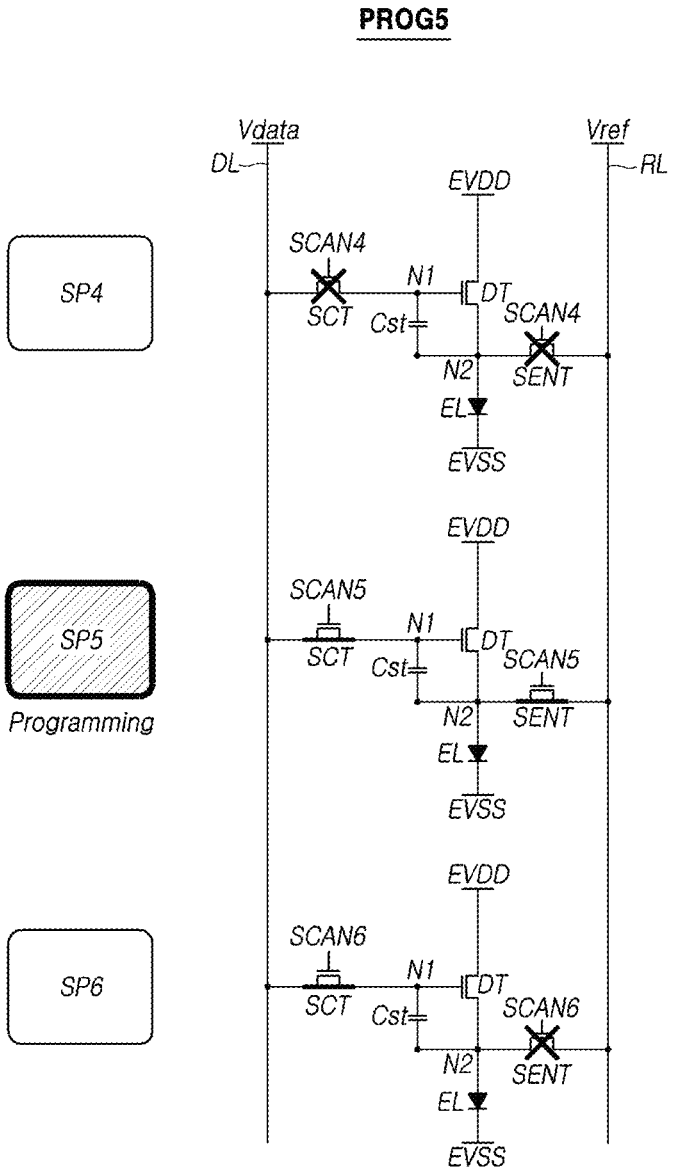
FIG. 14 is a diagram illustrating the states of a fifth subpixel and subpixels adjacent thereto at programming timing of the fifth subpixel after terminating black data insertion driving.

FIG. 11 is a driving timing diagram in the case where a display device 100 according to embodiments of the present disclosure performs black data insertion driving and advanced overlap driving. FIG. 12 is a diagram illustrating the states of a third subpixel SP3 and subpixels SP2 and SP4 adjacent thereto at programming timing of a third subpixel SP3. FIG. 13 is a diagram illustrating the states of a fourth subpixel SP4 and subpixels SP3 and SP5 adjacent thereto at programming timing of the fourth subpixel SP4 before starting black data insertion driving. FIG. 14 is a diagram illustrating the states of a fifth subpixel SP5 and subpixels SP4 and SP6 adjacent thereto at programming timing of the fifth subpixel SP5 after terminating black data insertion driving.

Referring to FIG. 11, a plurality of subpixels SP may include a fourth subpixel SP4 connected to a fourth scan signal line SCL4 for transmitting a fourth scan signal SCAN4 and a fourth sense signal line SENL4 for transmitting a fourth sense signal SENSE4, a fifth subpixel SP5 connected to a fifth scan signal line SCL5 for transmitting a fifth scan signal SCAN5 and a fifth sense signal line SENL5 for transmitting a fifth sense signal SENSE5, a sixth subpixel SP6 connected to a sixth scan signal line SCL6 for transmitting a sixth scan signal SCAN6 and a sixth sense signal line SENL6 for transmitting a sixth sense signal SENSE6, and the like.

In FIG. 11, the fourth subpixel SP4 represents subpixels SPrc (r=4 and c=1 to 4) arranged in the fourth subpixel row R(n+4) in FIG. 9. In FIG. 11, the fifth subpixel SP5 represents subpixels SPrc (r=5 and c=1 to 4) arranged in the fifth subpixel row R(n+5) in FIG. 9. In FIG. 11, the sixth subpixel SP6 represents subpixels SPrc (r=6 and c=1 to 4) arranged in the sixth subpixel row R(n+6) in FIG. 9.

Referring to FIG. 11, the fourth sense signal SENSE4 has a turn-off level voltage during the period in which the interval of a turn-on level voltage of the third scan signal SCAN3 overlaps the interval of a turn-on level voltage of the third sense signal SENSE3 (i.e., a programming period tPROG of the third subpixel SP3).

The second sense signal SENSE2 switches from a turn-on level voltage to a turn-off level voltage at a timing PROG3 before the period in which the interval of a turn-on level voltage of the third scan signal SCAN3 overlaps the interval of a turn-on level voltage of the third sense signal SENSE3 (i.e., the programming period tPROG of the third subpixel SP3) ends.

Referring to FIG. 12, both a scan transistor SCT and a sense transistor SENT in the third subpixel SP3 are in a turn-on state during the programming period tPROG of the third subpixel SP3 in which the interval of a turn-on level voltage of the third scan signal SCAN3 overlaps the interval of a turn-on level voltage of the third sense signal SENSE3.

The second node N2 of the driving transistor DT in the third subpixel SP3 is electrically connected to a reference line RL by a sense transistor SENT that is turned on during the programming period tPROG of the third subpixel SP3.

The sense transistor SENT in the fourth subpixel SP4 may be in a turn-off state by the fourth sense signal SENSE4 of a turn-off level voltage during the programming period tPROG of the third subpixel SP3. Accordingly, the reference line RL, which is electrically connected to the second node N2 of the driving transistor DT in the third subpixel SP3 through the sense transistor SENT that is turned on, is not affected by the fourth subpixel SP4.

The sense transistor SENT in the second subpixel SP2 may be in a turn-off state by the second sense signal SENSE2 having a turn-off level voltage at a timing PROG3 of the programming period tPROG of the third subpixel SP3. Accordingly, the reference line RL, which is electrically connected to the second node N2 of the driving transistor DT in the third subpixel SP3 through the sense transistor SENT that is turned on, is not affected by the second subpixel SP2.

According to the advanced overlap driving described above, since there is a timing PROG3 at which all sense transistors SENT in the subpixels SP2 and SP4 adjacent to the third subpixel SP3 are turned off during the programming period tPROG of the third subpixel SP3, the third subpixel SP3 may not be affected by the neighboring subpixels SP2 and SP4, and may perform a normal program operation, thereby emitting light of desired brightness.

Referring to FIG. 11, a fifth sense signal SENSE5 has a turn-off level voltage during the period in which the interval of a turn-on level voltage of the fourth scan signal SCAN4 overlaps the interval of a turn-on level voltage of the fourth sense signal SENSE4 (i.e., a programming period tPROG of the fourth subpixel SP4).

A third sense signal SENSE3 switches from a turn-on level voltage to a turn-off level voltage at a timing PROG4 before the period in which the interval of a turn-on level voltage of the fourth scan signal SCAN4 overlaps the interval of a turn-on level voltage of the fourth sense signal SENSE4 (i.e., the programming period tPROG of the fourth subpixel SP4) ends.

Referring to FIG. 13, both a scan transistor SCT and a sense transistor SENT in the fourth subpixel SP4 are in a turn-on state during the programming period tPROG of the fourth subpixel SP4, which corresponds to the period in which the interval of a turn-on level voltage of the fourth scan signal SCAN4 overlaps the interval of a turn-on level voltage of the fourth sense signal SENSE4.

The second node N2 of the driving transistor DT in the fourth subpixel SP4 is electrically connected to the reference line RL by a sense transistor SENT that is turned on during the programming period tPROG of the fourth subpixel SP4.

A sense transistor SENT in the fifth subpixel SP5 may be in a turn-off state by a fifth sense signal SENSE5 having a turn-off level voltage during the programming period tPROG of the fourth subpixel SP4. Accordingly, the reference line RL, which is electrically connected to the second node N2 of the driving transistor DT in the fourth subpixel SP4 through the sense transistor SENT that is turned on, is not affected by the fifth subpixel SP5.

The sense transistor SENT in the third subpixel SP3 may be in a turn-off state by a third sense signal SENSE3 having a turn-off level voltage at a timing PROG4 of the programming period tPROG of the fourth subpixel SP4. Accordingly, the reference line RL, which is electrically connected to the second node N2 of the driving transistor DT in the fourth subpixel SP4 through the sense transistor SENT that is turned on, is not affected by the third subpixel SP3.

According to the advanced overlap driving described above, since there is a timing PROG4 in which all sense transistors SENT in the subpixels SP3 and SP5 adjacent to the fourth subpixel SP4 are turned off during the programming period tPROG of the fourth subpixel SP4, the fourth subpixel SP4 may perform a normal program operation without being affected by the adjacent subpixels SP3 and SP5, thereby emitting light of desired brightness.

Referring to FIG. 11, a sixth sense signal SENSE6 has a turn-off level voltage during the period in which the interval of a turn-on level voltage of the fifth scan signal SCAN5 overlaps the interval of a turn-on level voltage of the fifth sense signal SENSE5 (i.e., a programming period tPROG of the fifth subpixel SP5).

The fourth sense signal SENSE4 switches from a turn-on level voltage to a turn-off level voltage at a timing PROG5 before the period in which the interval of a turn-on level voltage of the fifth scan signal SCAN5 overlaps the interval of a turn-on level voltage of the fifth sense signal SENSE5 (i.e., the programming period tPROG of the fifth subpixel SP5) ends.

Referring to FIG. 14, both a scan transistor SCT and a sense transistor SENT in the fifth subpixel SP5 are in a turn-on state during the programming period tPROG of the fifth subpixel SP5, which corresponds to the period in which the interval of a turn-on level voltage of the fifth scan signal SCAN5 overlaps the interval of a turn-on level voltage of the fifth sense signal SENSE5.

The second node N2 of the driving transistor DT in the fifth subpixel SP5 is electrically connected to the reference line RL by the sense transistor SENT that is turned on during the programming period tPROG of the fifth subpixel SP5.

The sense transistor SENT in the sixth subpixel SP6 may be in a turn-off state by a sixth sense signal SENSE6 having a turn-off level voltage during the programming period tPROG of the fifth subpixel SP5. Accordingly, the reference line RL, which is electrically connected to the second node N2 of the driving transistor DT in the fifth subpixel SP5 through the sense transistor SENT that is turned on, is not affected by the sixth subpixel SP6.

The sense transistor SENT in the fourth subpixel SP4 may be in a turn-off state by a fourth sense signal SENSE4 having a turn-off level voltage at a timing PROG5 of the programming period tPROG of the fifth subpixel SP5. Accordingly, the reference line RL, which is electrically connected to the second node N2 of the driving transistor DT in the fifth subpixel SP5 through the sense transistor SENT that is turned on, is not affected by the fourth subpixel SP4.

According to the advanced overlap driving described above, since there is a timing PROG5 at which all sense transistors SENT in the subpixels SP4 and SP6 adjacent to the fifth subpixel SP5 are turned off during the programming period tPROG of the fifth subpixel SP5, the fifth subpixel SP5 may perform a normal program operation without being affected by the adjacent subpixels SP4 and SP6, thereby emitting light of desired brightness.

Referring to FIG. 11, a fake data voltage Vfake that is distinct from a real image data voltage Vdata may be supplied to the subpixels SP arranged in k (k is a natural number of 1 or more) subpixel lines (subpixel rows) during a fake data insertion (FDI) driving period between the period in which a fourth scan signal SCAN4 having a turn-on level voltage is supplied to a fourth scan signal line SCL4 and the period in which a fifth scan signal SCAN5 having a turn-on level voltage is supplied to the fifth scan signal line SCL5.

Here, the fake data insertion (FDI) is also referred to as, for example, "black data insertion (BDI)" in which black data is inserted.

In generalizing the above, a fake data voltage Vfake that is distinct from a real image data voltage Vdata may be supplied to the subpixels SP arranged in k ("k" is a natural number of 1 or more) subpixel lines (subpixel rows) during a fake data insertion (FDI) driving period between the period in which the $i^{th}$ ("i" is a natural number of 1 or more) scan signal SCAN having a turn-on level voltage is supplied to the $i^{th}$ scan signal line of a plurality of scan signal lines and the period in which the $(i+1)^{th}$ scan signal SCAN having a turn-on level voltage is supplied to the $(i+1)^{th}$ scan signal line of the plurality of scan signal lines.

Referring to FIG. 11, the data driving circuit 120 may output a fake data voltage Vfake that is distinct from a real image data voltage Vdata to all or some of a plurality of data lines DL during a fake data insertion driving period tFDI between the interval of a turn-on level voltage of the fourth scan signal SCAN4 and the interval of a turn-on level voltage of the fifth scan signal SCAN5.

The fake data voltage Vfake may be supplied to the subpixels SP arranged in k (k is a natural number of 1 or more) subpixel lines (subpixel rows).

For example, the fake data voltage Vfake may be a black data voltage Vblack, a low-grayscale data voltage, or the like. In the case where the fake data voltage Vfake is a black data voltage Vblack, fake data insertion (FDI) driving is referred to as "black data insertion (BDI) driving".

Referring to FIG. 11, a pre-charge driving period tPC may follow the fake data insertion driving period tFDI.

Referring to FIG. 11, the data driving circuit 120 may output a pre-charge data voltage Vpre to all or some of a plurality of data lines DL during the pre-charge driving period tPC after outputting the fake data voltage Vfake during the fake data insertion driving period tFDI.

Referring to FIG. 11, after the time at which the data driving circuit 120 starts outputting the pre-charge data voltage Vpre, the first gate driving circuit 130 may output a fifth scan signal SCAN5 having a turn-on level voltage to the fifth scan signal line SCL5.

The period in which the interval of a turn-on level voltage of the fifth scan signal SCAN5 overlaps the interval of a turn-on level voltage of the fifth sense signal SENSE5 (i.e., a prograrnning period of the fifth subpixel SP5) may follow the period in which the data driving circuit 120 outputs the pre-charge data voltage Vpre (i.e., a pre-charge driving period tPC).

Figure 15:
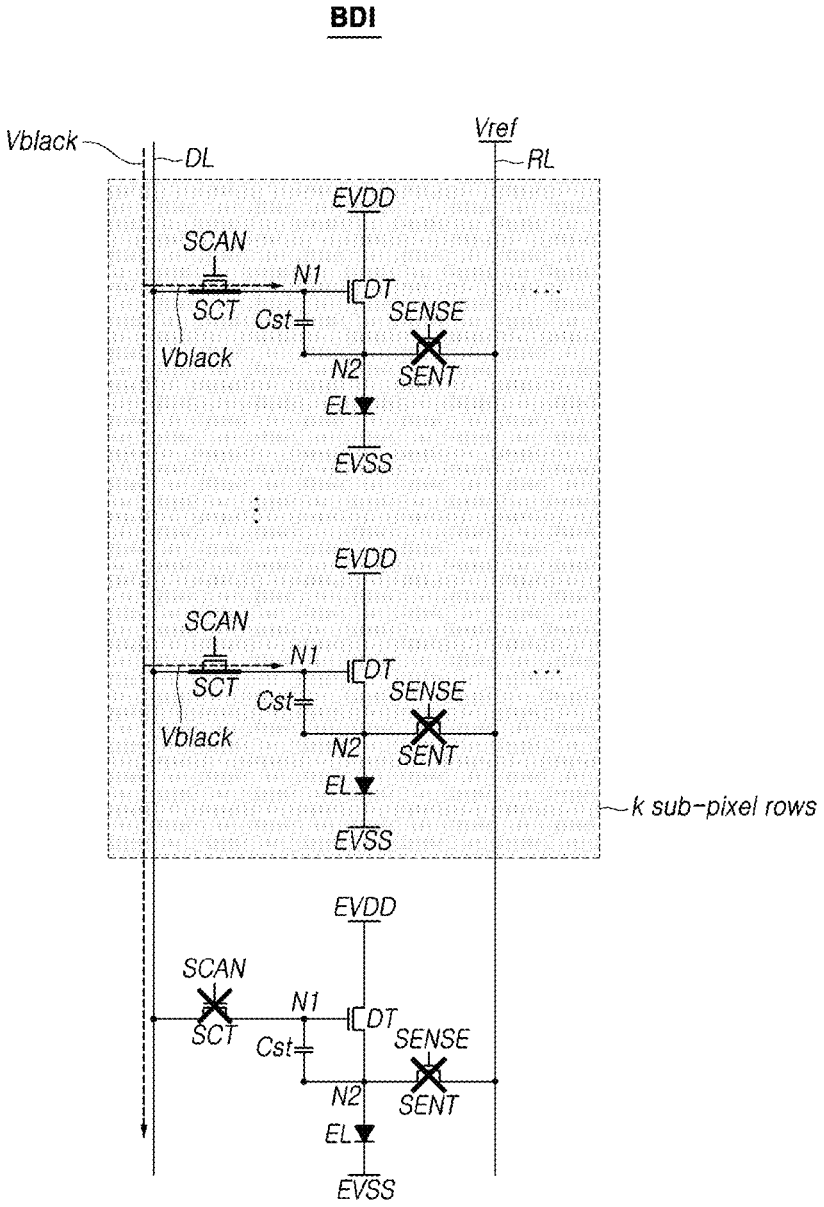
FIG. 15 is a diagram illustrating black data insertion driving of a display device according to embodiments of the present disclosure.

FIG. 15 is a diagram illustrating fake data insertion driving (e.g., black data insertion driving) of a display device 100 according to embodiments of the present disclosure.

Referring to FIG. 15, a fake data voltage Vfake for fake data insertion is applied to first nodes N1 of driving transistors DT in k subpixels SP during a fake data insertion driving period tFDI.

Accordingly, when the data driving circuit 120 outputs the fake data voltage Vfake, all scan transistors SCT in the k subpixels SP are in a turn-on state, and all scan transistors SCT in the remaining subpixels SP, excluding the k subpixel SP, are in a turn-off state.

When the data driving circuit 120 outputs the fake data voltage Vfake, all sense transistors SENT in all the subpixels SP that including the k subpixels SP and the remaining subpixels SP are in a turn-off state.

In other words, the first gate driving circuit 130 may output scan signals having a turn-on level voltage to k scan signal lines corresponding to the k subpixel lines, among a plurality of scan signal lines SCL, and may output scan signals having a turn-off level voltage to the remaining scan signal lines during the fake data insertion driving period tFDI when the data driving circuit 120 outputs the fake data voltage Vfake. The second gate driving circuit 140 may output sense signals having a turn-off level voltage to all of a plurality of sense signal lines SENL.

Figure 16:
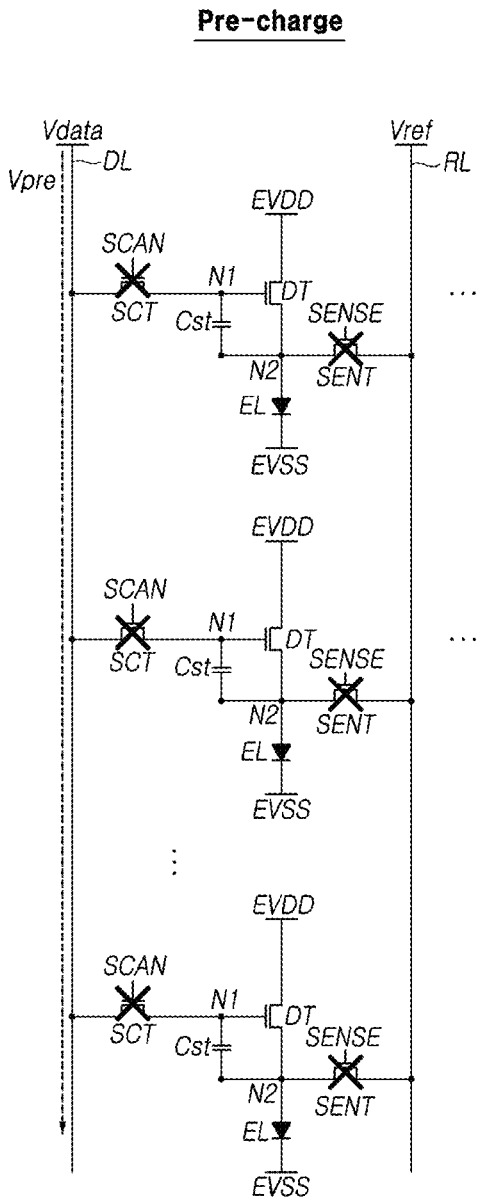
FIG. 16 is a diagram illustrating pre-charge driving of a display device according to embodiments of the present disclosure.

FIG. 16 is a diagram illustrating pre-charge driving of a display device 100 according to embodiments of the present disclosure.

Referring to FIG. 16, the first gate driving circuit 130 may output scan signals SCAN having a turn-off level voltage to all of a plurality of scan signal lines SCL, and the second gate driving circuit 140 may output sense signals SENSE having a turn-off level voltage to all of a plurality of sense signal lines SENL during a pre-charge driving period tPC when the data driving circuit 120 outputs a pre-charge data voltage Vpre.

The pre-charge data voltage Vpre is applied only to a plurality of data lines DL, instead of a plurality of subpixels SP, during the pre-charge driving period tPC.

In other words, the pre-charge data voltage Vpre is applied only to a plurality of data lines DL, and is not applied to a first node N1 of a driving transistor DT of each of a plurality of subpixels SP during the pre-charge driving period tPC.

Figure 17:
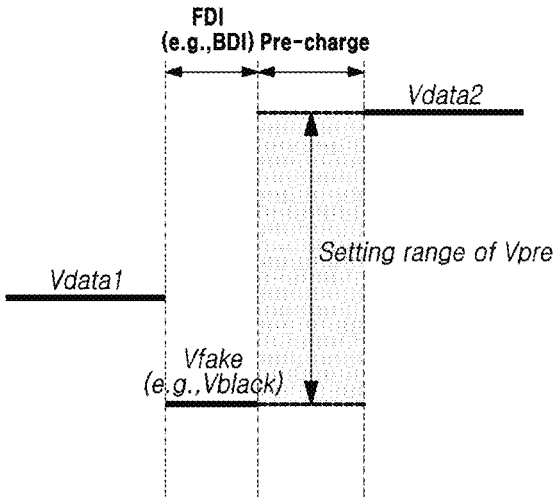
FIG. 17 is a diagram illustrating a setting range of a pre-charge data voltage used in pre-charge driving of a display device according to embodiments of the present disclosure.

FIG. 17 is a diagram illustrating a setting range of a pre-charge data voltage Vpre used in pre-charge driving of a display device 100 according to embodiments of the present disclosure.

Referring to FIG. 17, in addition, a pre-charge data voltage Vpre applied to one or more data lines DL during a pre-charge driving period tPC may be one of a first image data voltage Vdata1 output before outputting the pre-charge data voltage Vpre, a second image data voltage Vdata2 to be output after outputting the pre-charge data voltage Vpre, a fake data voltage Vfake, and a voltage between the higher voltage of the first image data voltage Vdata1 and the second image data voltage Vdata2, and the fake data voltage Vfake.

Referring to FIG. 17, the pre-charge data voltage Vpre may be set within a setting range in which the fake data voltage Vfake is a lower limit value and in which the higher voltage of the first image data voltage Vdata1 and the second image data voltage Vdata2 is a higher limit value.

Figure 18:
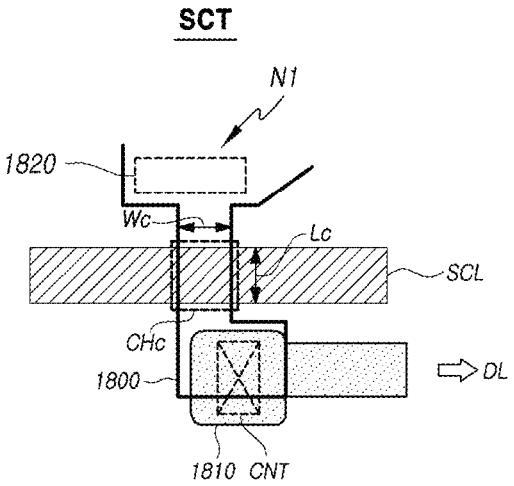
FIG. 18 is a diagram illustrating a scan transistor of a display device according to embodiments of the present disclosure.
Figure 19:
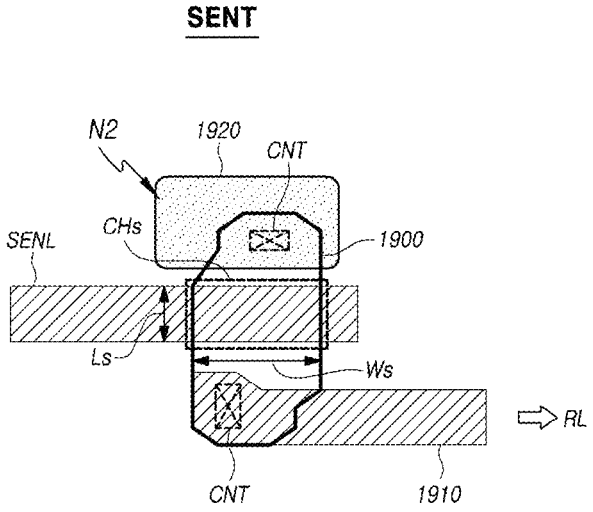
FIG. 19 is a diagram illustrating a sense transistor of a display device according to embodiments of the present disclosure.

FIG. 18 is a diagram illustrating a scan transistor SCT of a display device 100 according to embodiments of the present disclosure, and FIG. 19 is a diagram illustrating a sense transistor SENT of a display device 100 according to embodiments of the present disclosure. The circuit diagram of the subpixel SP shown in FIG. 2 will be also referred to.

Referring to FIG. 18, a scan transistor SCT may include a first scan pattern 1810 that serves as a drain node (or a source node) of the scan transistor SCT and is electrically connected to a data line DL, a second scan pattern 1820 that serves as a source node (or a drain node) of the scan transistor SCT and is electrically connected to a first node N1 of a driving transistor DT, a gate electrode 1800 connected to the first scan pattern 1810 through a contact hole CNT at one side thereof and connected to or integrated with the second scan pattern 1820 at the opposite side thereof, thereby electrically connecting the first scan pattern 1810 to the second scan pattern 1820, and the like.

The scan signal line SCL may be arranged to overlap the gate electrode 1800 of the scan transistor SCT. The part of the gate electrode 1800 of the scan transistor SCT, which overlaps the scan signal line SCL, corresponds to a channel CHc of the scan transistor SCT. The channel CHc of the scan transistor SCT has a channel width Wc and a channel length Lc.

The ratio Wc/Lc of the channel width Wc to the channel length Lc in the scan transistor SCT may determine the characteristics of the channel CHc of the scan transistor SCT. The ratio Wc/Lc of the channel width Wc to the channel length Lc in the scan transistor SCT may determine the on-off characteristics and switching performance of the scan transistor SCT.

Referring to FIG. 19, the sense transistor SENT may include a first pattern 1910 that serves as a drain node (or a source node) of the sense transistor SENT and is electrically connected to a reference line RL, a second pattern 1920 that serves as a source node (or a drain node) of the sense transistor SENT and is electrically connected to a second node N2 of a driving transistor DT, a gate electrode 1900 connected to the first pattern 1910 through a contact hole CNT at one side thereof and connected to the second pattern 1920 through another contact hole CNT at the opposite side thereof, thereby connecting the first pattern 1910 to the second pattern 1920, and the like.

The sense signal line SENL may be arranged to overlap the gate electrode 1900 of the sense transistor SENT. The part of the gate electrode 1900 of the sense transistor SENT, which overlaps the sense signal line SENL, corresponds to a channel CHs of the sense transistor SENT. The channel CHs of the sense transistor SENT has a channel width Ws and a channel length Ls.

The ratio Ws/Ls of the channel width Ws to the channel length Ls in the sense transistor SENT may determine the characteristics of the channel CHs of the sense transistor SENT. The ratio Ws/Ls of the channel width Ws to the channel length Ls in the sense transistor SENT may determine the on-off characteristics and switching performance of the sense transistor SENT.

Referring to FIG. 18 and FIG. 19, the ratio Ws/Ls of the channel width Ws to the channel length Ls of the sense transistor SENT may be greater than the ratio Wc/Lc of the channel width Wc to the channel length Lc of the scan transistor SCT.

According to the advanced overlap driving, since the interval of a turn-on level voltage of the sense signal SENSE in any one subpixel SP is delayed from the interval of a turn-on level voltage of the scan signal SCAN by a sense shift time tSHIT/SEN, in order for normal charging and a normal programming operation, the sense transistor SENT is required to have a faster turn-on speed than the turn-on speed of the scan transistor SCT.

Accordingly, as described above, by designing the ratio Ws/Ls of the channel width Ws to the channel length Ls of the sense transistor SENT to be greater than the ratio Wc/Lc of the channel width Wc to the channel length Lc of the scan transistor SCT, it is possible to secure a sufficient time for charging the storage capacitor Cst while performing the above-described advanced overlap driving. Accordingly, the programming operation of a corresponding subpixel SP is able to be performed quickly and normally.

Meanwhile, in the case where a plurality of subpixels SP include subpixels that emit different lights (e.g., a subpixel emitting a red light, a subpixel emitting a green light, a subpixel emitting a blue light, and a subpixel emitting a white light), the ratios Ws/Ls of the channel width Ws to the channel length Ls of sense transistors SENT in the respective subpixels emitting different lights may be the same.

Alternatively, the ratio Ws/Ls of the channel width Ws to the channel length Ls of the sense transistor SENT in at least one subpixel among the four subpixels emitting different lights may be different from the ratios Ws/Ls of the channel width Ws to the channel length Ls of the sense transistors SENT in the remaining subpixels.

Figure 20:
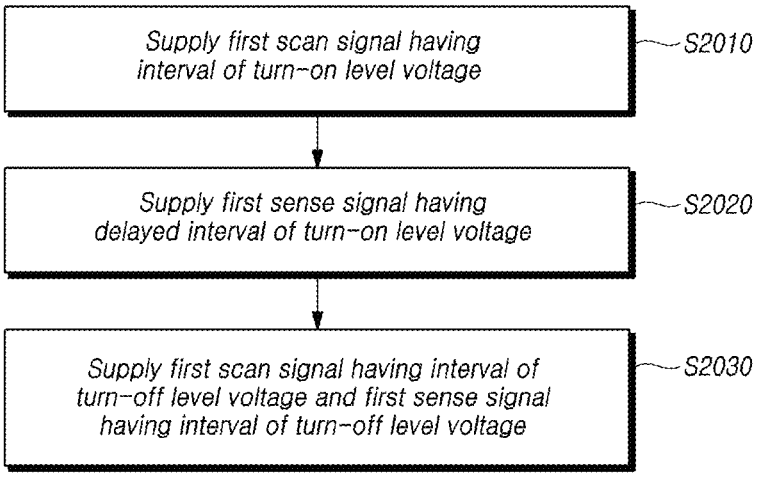
FIG. 20 is a flowchart illustrating a method of driving a display device according to embodiments of the present disclosure.

FIG. 20 is a flowchart illustrating a method of driving a display device 100 according to embodiments of the present disclosure.

Referring to FIG. 20, a method of driving the display device 100 including a plurality of subpixels SP may include a step S2010 of supplying a first scan signal SCAN1 having an interval of a turn-on level voltage to a first scan signal line SCL1 connected to a gate node of a scan transistor SCT in a first subpixel SP1 among the plurality of subpixels SP, a step S2020 of supplying a first sense signal SENSE1 having an interval of a turn-on level voltage, which is delayed from the interval of a turn-on level voltage of the first scan signal SCAN1 by a predetermined sense shift time tSHIFT/SEN, to a first sense signal line SENL1 electrically connected to a gate node of a sense transistor SENT in the first subpixel SP1, a step S2030 of supplying the first scan signal SCAN1 having the interval of a turn-off level voltage to the first scan signal line SCL1 and supplying the first sense signal SENSE1 having the interval of a turn-off level voltage to the first sense signal line SENL1, and the like.

In step S2010, the display device 100 may transmit an image data voltage Vdata supplied to a data line DL to a first node N1 of a driving transistor DT in the first subpixel SP1 through a scan transistor SCT that is turned on.

In step S2020, the display device 100 may transmit a reference voltage Vref supplied to a reference line RL to a second node N2 of the driving transistor DT through a sense transistor SENT that is turned on.

In step S2030, the voltages of the first node N1 and the second node N2 of the driving transistor DT increase. Here, the second node N2 of the driving transistor DT may be electrically connected to a first electrode of an emission element EL.

In step S2030, if the voltage of the second node N2 of the driving transistor DT increases to a specific level or more, current flows to the emission element EL, so that the emission element EL starts to emit light.

The interval of a turn-on level voltage of the first sense signal SENSE1 may include a period OP in which the interval of a turn-on level voltage of the first sense signal SENSE1 overlaps the interval of a turn-on level voltage of the first scan signal SCAN and a period NOP in which the interval of a turn-on level voltage of the first sense signal SENSE1 does not overlap the interval of a turn-on level voltage of the first scan signal SCAN1.

The start point of the interval of a turn-on level voltage of the first sense signal SENSE1 may be delayed from the start point of the interval of a turn-on level voltage of the first scan signal SCAN1 by a sense shift time tSHIFT/SEN, and the sense shift time tSHIFT/SEN may correspond to ½ of the interval of a turn-on level voltage of the first scan signal SCAN1.

A plurality of subpixels SP may further include a second subpixel SP2 and a third subpixel SP3, and drain nodes or source nodes of the sense transistors SENT included in the first subpixel SP1, the second subpixel SP2, and the third subpixel SP3 may be electrically connected to the same reference line.

There may be a timing PROG2 at which the sense transistor SENT in the first subpixel SP1 and the sense transistor SENT in the third subpixel SP3 are simultaneously turned off while a second scan signal SCAN2 having a turn-on level voltage is supplied to the gate node of the scan transistor SCT in the second subpixel SP2 and while a second sense signal SENSE2 having a turn-on level voltage is supplied to the gate node of the sense transistor SENT in the second subpixel SP2.

A fake data voltage Vfake that is distinct from a real image data voltage Vdata may be supplied to the subpixels SP arranged in k ("k" is a natural number of 1 or more)

subpixel lines (subpixel rows) during a fake data insertion (FDI) driving period between the period in which the $i^{th}$ ("i" is a natural number of 1 or more) scan signal SCAN having a turn-on level voltage is supplied to the $i^{th}$ scan signal line of a plurality of scan signal lines and the period in which the $(i+1)^{th}$ scan signal SCAN having a turn-on level voltage is supplied to the $(i+1)^{th}$ scan signal line of the plurality of scan signal lines.

Figure 21:
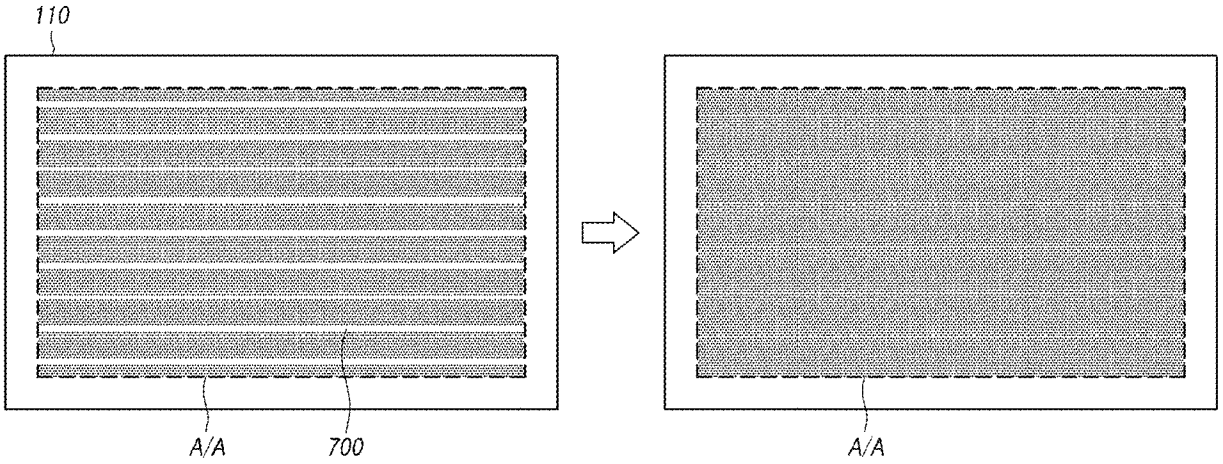
FIG. 21 is a diagram for explaining an effect of preventing defects of brightness in specific lines in the case where a display device according to embodiments of the present disclosure performs fake data insertion driving and advanced overlap driving.

FIG. 21 is a diagram explaining an effect of preventing defects of brightness in specific lines in the case where a display device 100 according to embodiments of the present disclosure performs fake data insertion driving and advanced overlap driving.

As described above, in the case of the overlap driving described above with reference to FIG. 5 and FIG. 6, if fake data insertion driving is performed during the overlap driving, there may be a specific-line brightness phenomenon in which the subpixel row is viewed as a bright line 700 immediately before the fake data insertion driving.

However, in the case of the advanced overlap driving, even if the fake data insertion driving is performed during the overlap driving, the characteristics of overlap driving do not change immediately before the fake data insertion driving through the advanced overlap driving in which the interval of a turn-on level voltage of the sense signal among two gate signals (a scan signal and a sense signal) is controlled to be delayed from the interval of a turn-on level voltage of the scan signal. That is, according to the advanced overlap driving, all of the respective subpixels on which the programming is performed are not affected by the adjacent subpixels.

Accordingly, according to the advanced overlap driving, it is possible to prevent a specific-line brightness phenomenon in which the subpixel row (e.g., the $4^{th}$ subpixel row, the $8^{th}$ subpixel row, or the like) is viewed as a bright line 700 immediately before the fake data insertion driving.

Figure 22:
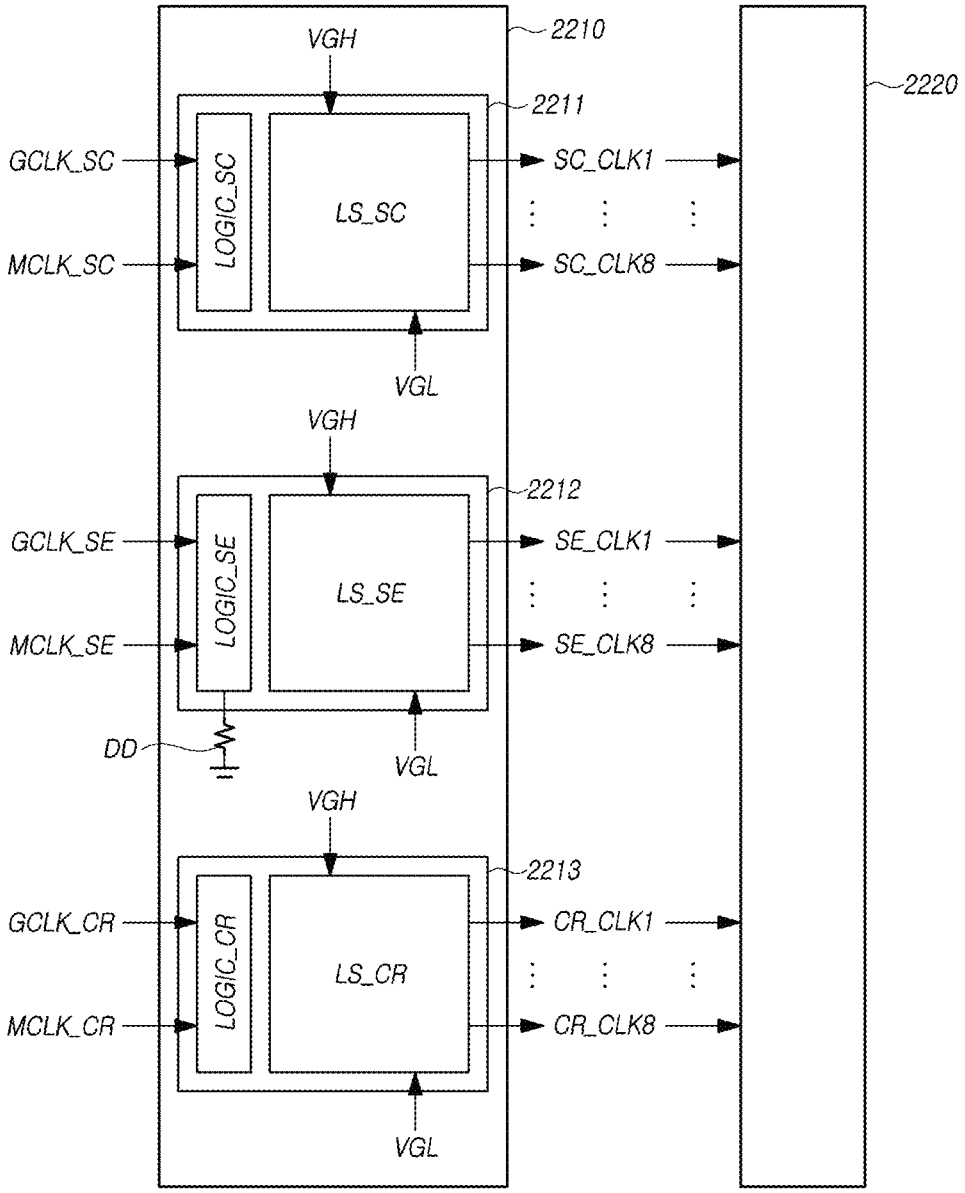
FIG. 22 is a diagram illustrating a gate driving circuit according to embodiments of the present disclosure.
Figure 23:
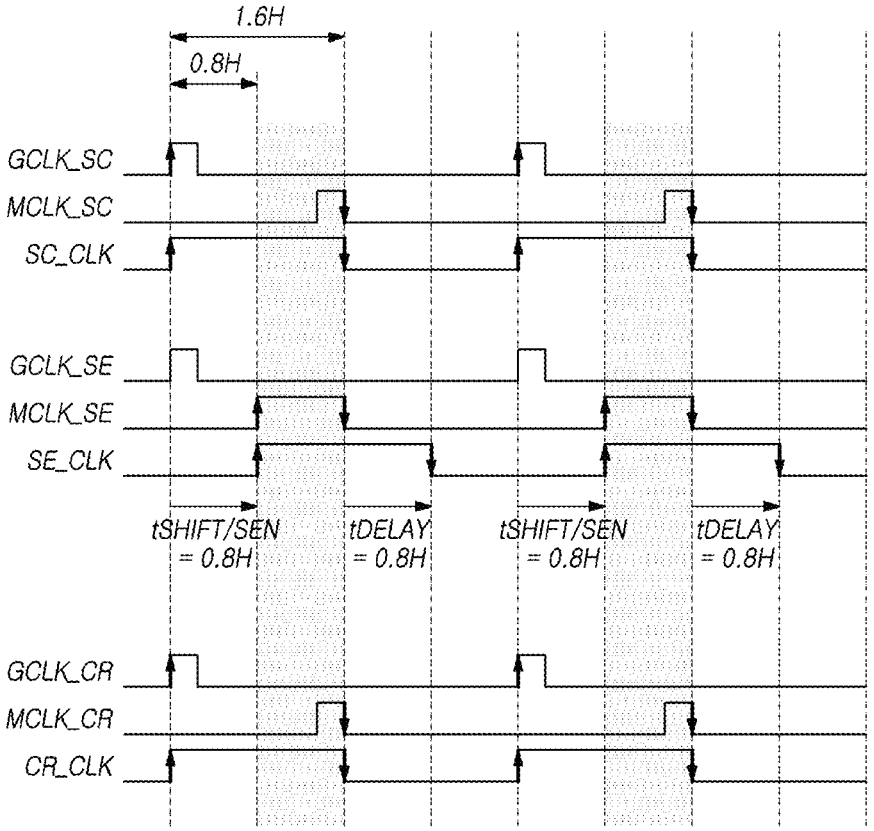
FIG. 23 is a timing diagram for driving a gate according to embodiments of the present disclosure.
Figure 24:
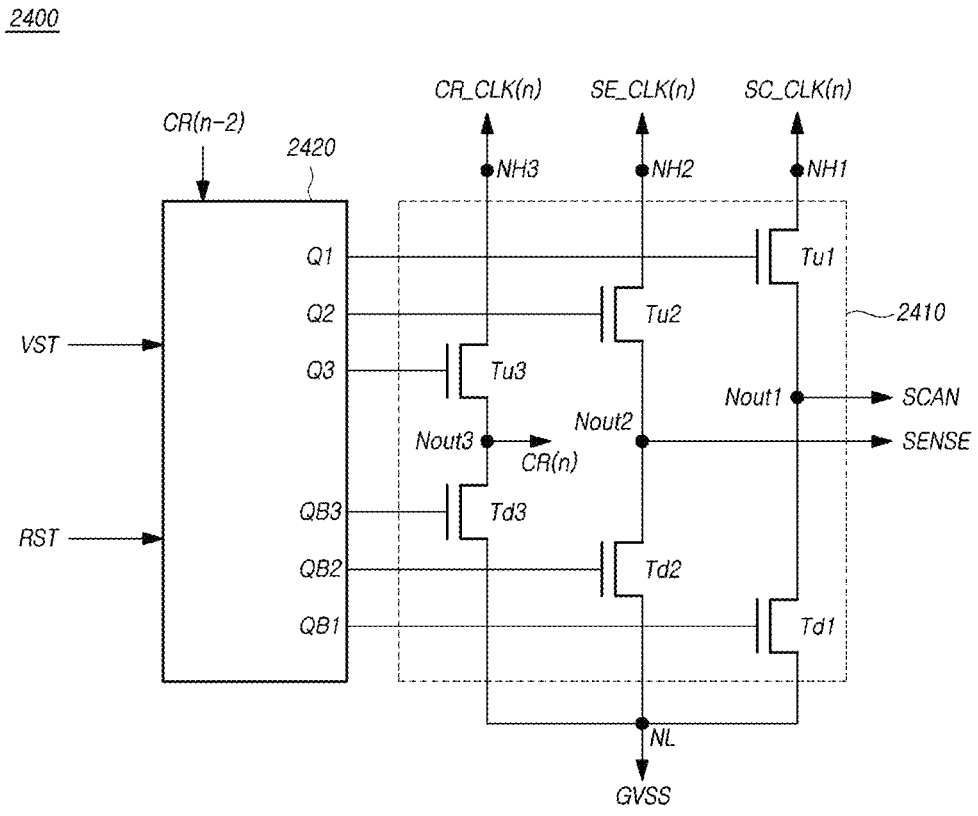
FIG. 24 is a diagram illustrating a gate signal output unit according to embodiments of the present disclosure.

FIG. 22 is a diagram illustrating a gate driving circuit 2200 according to embodiments of the present disclosure, FIG. 23 is a timing diagram for driving a gate according to embodiments of the present disclosure, and FIG. 24 is a diagram illustrating a gate signal output unit 2400 according to embodiments of the present disclosure.

Referring to FIG. 22, a gate driving circuit 2200 according to embodiments of the present disclosure may include a level shifter circuit 2210 and a gate signal outputter 2220.

Referring to FIG. 22, the level shifter circuit 2210 may include a scan clock signal generator 2211 and a sense clock signal generator 2212.

The scan clock signal generator 2211 may receive a first reference scan clock signal GCLK_SC and a second reference scan clock signal MCLK_SC, and may generate and output a plurality of scan clock signals (e.g., SC_CLK1 to SC_CLK8). The plurality of scan clock signals SC_CLK1 to SC_CLK8 may have signal waveforms shifted by a predetermined time.

The sense clock signal generator 2212 may receive a first reference sense clock signal GCLK_SE and a second reference sense clock signal MCLK_SE, and may generate and output a plurality of sense clock signals SE_CLK1 to SE_CLK8. The plurality of sense clock signals SE_CLK1 to SE_CLK8 may have signal waveforms shifted by a predetermined time.

If the gate driving circuit 2200 performs n-phase gate driving, n scan clock signals may be generated, and n sense clock signals may be generated. For example, as shown in FIG. 22, if the gate driving circuit 2200 performs 8-phase gate driving, eight scan clock signals SC_CLK1 to SC_CLK8 may be generated, and eight sense clock signals SE_CLK1 to SE_CLK8 may be generated.

Referring to FIG. 22, the level shifter circuit 2210 may further include a carry clock signal generator 2213.

Referring to FIG. 22, the gate signal outputter 2220 may output a scan signal SCAN having a turn-on level voltage interval, based on the plurality of sense clock signals SE_CLK1 to SE_CLK8, and may output a sense signal SENSE having a turn-on level voltage interval, based on the plurality of sense clock signal SE_CLK1 to SE_CLK8.

Referring to FIG. 22, the scan clock signal generator 2211 may include a scan logic unit LOGIC_SC and a scan level shifter LS_SC.

The scan logic unit LOGIC_SC may receive the first reference scan clock signal GCLK_SC and the second reference scan clock signal MCLK_SC, and may generate scan clock signals SC_CLK1 to SC_CLK8 that rise at the rising time of the first reference scan clock signal GCLK_SC and fall at the falling time of the second reference scan clock signal MCLK_SC.

The scan level shifter LS_SC may change and output voltage levels of the scan clock signals SC_CLK1 to SC_CLK8 generated by the scan logic unit LOGIC_SC.

The scan level shifter LS_SC may output scan clock signals SC_CLK1 to SC_CLK8.

The sense clock signal generator 2212 may include a sense logic unit LOGIC_SE, a delay device DD, and a sense level shifter LS_SE.

The sense logic unit LOGIC_SE may receive the first reference sense clock signal GCLK_SE and the second reference sense clock signal MCLK_SE, and may generate sense clock signals SE_CLK1 to SE_CLK8 according to the signal control logic.

The sense clock signals SE_CLK1 to SE_CLK8 generated according to the signal control logic may rise at the rising time of the second reference sense clock signal MCLK_SE, instead of the rising time of the first reference sense clock signal GCLK_SE, and may fall a predetermined delay time tDELAY after the falling time of the second reference sense clock signal MCLK_SE.

The delay device DD may delay the rising times of the sense clock signals SE_CLK1 to SE_CLK8 such that the sense clock signals SE_CLK1 to SE_CLK8 may rise at the rising time of the second reference sense clock signal MCLK_SE, instead of the rising time of the first reference sense clock signal GCLK_SE.

The sense level shifter LS_SE may change and output voltage levels of the sense clock signals SE_CLK1 to SE_CLK8 generated by the sense logic unit LOGIC_SE.

The sense level shifter LS_SE may output sense clock signals SE_CLK1 to SE_CLK8 that rise to a high level gate voltage and fall to a low level gate voltage and that have a high-level gate voltage interval delayed from the high-level gate voltage interval of the scan clock signals SC_CLK1 to SC_CLK8 by a sense shift time tSHIFT/SEN.

Referring to FIG. 22, for example, the delay device DD may include one or more resistor elements.

The carry clock signal generator 2213 may receive a first reference carry clock signal GCLK_CR and a second reference carry clock signal MCLK_CR, and may generate and output a plurality of carry clock signals CR_CLK1 to CR_CLK8.

Referring to FIG. 22, the carry clock signal generator 2213 may include a carry logic unit LOGIC_CR and a carry level shifter LS_CR.

The carry logic unit LOGIC_CR may receive a first reference carry clock signal GCLK_CR and a second reference carry clock signal MCLK_CR, and may generate a plurality of carry clock signals CR_CLK1 to CR_CLK8 that rise at the rising time of the first reference carry clock signal GCLK_CR and fall at the falling time of the second reference carry clock signal MCLK_CR. The plurality of carry clock signals CR_CLK1 to CR_CLK8 may have the same waveform as that of the plurality of scan clock signals SC_CLK1 to SC_CLK8.

The carry level shifter LS_CR may change and output voltage levels of the plurality of carry clock signals CR_CLK1 to CR_CLK8 generated by the carry logic unit LOGIC_CR.

The carry level shifter LS_CR may output a plurality of carry clock signals CR_CLK1 to CR_CLK8 that rise to a high level gate voltage and fall to a low level gate voltage.

Meanwhile, the level shifter circuit 2210 included in the gate driving circuit 2200 may be implemented as a single integrated circuit chip.

The gate signal outputter 2220 included in the gate driving circuit 2200 may be implemented as one or more integrated circuit chips.

Alternatively, the gate signal outputter 2220 included in the gate driving circuit 2200 may be implemented as a GIP (Gate-In-Panel) type. In this case, the gate signal outputter 2220 may be disposed in a non-display area of the display panel 110 in which scan signal lines SCL, to which scan signals SCAN are applied, and sense signal lines SENL, to which sense signals SENSE are applied, are arranged.

The gate driving circuit 2200 in FIG. 22 may be a circuit implemented by including the first gate driving circuit 130 and the second gate driving circuit 140 shown in FIG. 1.

Hereinafter, features of the scan clock signals SC_CLK1 to SC_CLK8, generated by the scan clock signal generator 2211, and the sense clock signals SE_CLK1 to SE_CLK8, generated by the sense clock signal generator 2212, will be described in more detail with reference to FIG. 23. However, for the convenience of explanation, the description will be made based on an example of one scan clock signal SC_CLK among the plurality of scan clock signals SC_CLK1 to SC_CLK8, one sense clock signal SE_CLK among the plurality of sense clock signals SE_CLK1 to SE_CLK8, and one carry clock signal CR_CLK among the plurality of carry clock signals CR_CLK1 to CR_CLK8.

Referring to FIG. 23, after the first reference scan clock signal GCLK_SC rises and falls, the second reference scan clock signal MCLK_SC may rise and fall.

After the first reference sense clock signal GCLK_SE rises and falls, the second reference sense clock signal MCLK_SE may rise and fall.

Referring to FIG. 23, the high-level gate voltage interval of the sense clock signal SE_CLK may be delayed from the high-level gate voltage interval of the scan clock signal SC_CLK by a predetermined sense shift time tSHIFT/SEN.

Therefore, the turn-on level voltage interval of the sense signal SENSE generated from the sense clock signal SE_CLK may be delayed from the turn-on level voltage interval of the scan signal SCAN generated from the scan clock signal SC_CLK by a sense shift time tSHIFT/SEN.

Referring to FIG. 23, the scan clock signal generator 2211 may generate and output a scan clock signal SC_CLK that rises at the rising time of the first reference scan clock signal GCLK_SC and falls at the falling time of the second reference scan clock signal MCLK_SC.

The sense clock signal generator 2212 may generate and output a sense clock signal SE_CLK that rises at the rising time of the second reference sense clock signal MCLK_SE, instead of the rising time of the first reference sense clock signal GCLK_SE, and falls a predetermined delay time tDELAY after the falling time of the second reference sense clock signal MCLK_SE.

The time interval between the rising time of the first reference sense clock signal GCLK_SE and the rising time of the second reference sense clock signal MCLK_SE may correspond to the sense shift time tSHIFT/SEN.

Referring to FIG. 23, the rising time of the first reference sense clock signal GCLK_SE may be the same as the rising time of the first reference scan clock signal GCLK_SC.

In order to indicate the rising time of the sense clock signal SE_CLK, the rising time of the second reference sense clock signal MCLK_SE may precede the rising time of the second reference scan clock signal MCLK_SC.

Referring to FIG. 23, the length of the time during which the scan clock signal SC_CLK and the sense clock signal SE_CLK overlap each other (e.g., 0.8H) may correspond to a value obtained by subtracting a delay time Tdelay (e.g., 0.8H) from the temporal length of the turn-on level voltage interval of the sense signal SENSE (e.g., 1.6H).

As described above, the gate signal outputter 2220 may output scan signals SCAN to a plurality of scan signal lines SCL, and may output sense signals SENSE to a plurality of sense signal lines SENL. The gate signal outputter 2220 may include a plurality of gate signal output units 2400 corresponding to a plurality of stages.

Referring to FIG. 24, each of the plurality of gate signal output units 2400 may output a scan signal SCAN to one scan signal line SCL, and may output a sense signal SENSE to one sense signal line SENL.

Each of the plurality of gate signal output units 2400 may include an output buffer circuit 2410 and a control logic circuit 2420.

The output buffer circuit 2410 may include a first pull-up transistor Tu1 and a first pull-down transistor Td1 for outputting the $n^{th}$ scan signal SCAN(n), may include a second pull-up transistor Tu2 and a second pull-down transistor Td2 for outputting the $n^{th}$ sense signal SENSE(n), and may include a third pull-up transistor Tu3 and a third pull-down transistor Td3 for outputting the $n^{th}$ carry signal CR(n).

The first pull-up transistor Tu1 and the first pull-down transistor Td1 may be connected in series between a first clock signal node NH1 to which the $n^{th}$ phase scan clock signal SC_CLK(n) is applied and a gate base node NL to which a gate base voltage GVSS is applied.

A first connection point Nout1 at which the first pull-up transistor Tu1 and the first pull-down transistor Td1 are connected to each other may be a point from which the scan signal SCAN is output, and may be electrically connected to the scan signal line SCL.

The second pull-up transistor Tu2 and the second pull-down transistor Td2 may be connected in series between a second clock signal node NH2 to which the $n^{th}$ phase sense clock signal SE_CLK(n) is applied and the gate base node NL to which the gate base voltage GVSS is applied.

A second connection point Nout2 at which the second pull-up transistor Tu2 and the second pull-down transistor Td2 are connected to each other may be a point from which the sense signal SENSE is output, and may be electrically connected to the sense signal line SENL.

The third pull-up transistor Tu3 and the third pull-down transistor Td3 may be connected in series between a third clock signal node NH3 to which the $n^{th}$ phase scan clock signal CR_CLK(n) is applied and the gate base node NL to which the gate base voltage GVSS is applied.

A third connection point Nout3 at which the third pull-up transistor Tu3 and the third pull-down transistor Td3 are connected to each other may be a point from which the $n^{th}$ carry signal CR(n) is output.

The $n^{th}$ carry signal CR(n) may be input to a gate signal output unit 2400 of a stage {e.g., the $(n+2)^{th}$ stage} subsequent to the gate signal output unit 2400 in FIG. 24.

The gate node of the first pull-up transistor Tu1 may be electrically connected to a node Q1. The first pull-up transistor Tu1 may be controlled to be turned on and off according to the voltage of the node Q1.

The gate node of the second pull-up transistor Tu2 may be electrically connected to a node Q2. The second pull-up transistor Tu2 may be controlled to be turned on and off according to the voltage of the node Q2.

The gate node of the third pull-up transistor Tu3 may be electrically connected to a node Q3. The third pull-up transistor Tu3 may be controlled to be turned on and off according to the voltage of the node Q3.

The gate node of the first pull-down transistor Td1 may be electrically connected to a node QB1. The first pull-down transistor Td1 may be controlled to be turned on and off according to the voltage of the node QB1.

The gate node of the second pull-down transistor Td2 may be electrically connected to a node QB2. The second pull-down transistor Td2 may be controlled to be turned on and off according to the voltage of the node QB2.

The gate node of the third pull-down transistor Td3 may be electrically connected to a node QB3. The third pull-down transistor Td3 may be controlled to be turned on and off according to the voltage of the node QB3.

The control logic circuit 2420 may receive a carry signal CR(n−2), a start signal VST, and a reset signal RST of the previous stage, thereby controlling the voltages of the node Q1, the node Q2, and the node Q3 and controlling the voltages of the node QB1, the node QB2, and the node QB3. The control logic circuit 2420 may include a plurality of transistors and one or more capacitors.

The node Q1, the node Q2, and the node Q3 may be electrically isolated nodes. Alternatively, all of the node Q1, the node Q2, and the node Q3 may be electrically connected nodes. Alternatively, the node Q1 and the node Q3 may be electrically connected, and the node Q2 may be electrically isolated from the node Q1 and the node Q3.

The node QB1, the node QB2, and the node QB3 may be electrically isolated nodes. Alternatively, all of the node QB1, the node QB2, and the node QB3 may be electrically connected nodes. Alternatively, the node QB1 and the node QB3 may be electrically connected, and the node QB2 may be electrically isolated from the node QB1 and the node QB3.

If the first pull-up transistor Tu1 is turned on, the first pull-down transistor Td1 may be turned off. At this time, a scan signal SCAN having a turn-on level voltage interval (e.g., a high-level gate voltage interval) may be output, based on the scan clock signal SC_CLK(n), through the first pull-up transistor Tu1.

If the first pull-up transistor Tu1 is turned off, the first pull-down transistor Td1 may be turned on. At this time, a scan signal SCAN having a turn-off level voltage interval (e.g., a low-level gate voltage interval) may be output, based on the gate base voltage GVSS, through the first pull-down transistor Td1.

If the second pull-up transistor Tu2 is turned on, the second pull-down transistor Td2 may be turned off. At this time, a sense signal SENSE having a turn-on level voltage interval (e.g., a high-level gate voltage interval) may be output, based on the sense clock signal SE_CLK(n), through the second pull-up transistor Tu2. The sense signal SENSE may have a turn-on level voltage interval shifted from the turn-on level voltage interval of the scan signal SCAN by a sense shift time tSHIFT/SEN.

If the second pull-up transistor Tu2 is turned off, the second pull-down transistor Td2 may be turned on. At this time, a sense signal SENSE having a turn-off level voltage interval (e.g., a low-level gate voltage interval) may be output, based on the gate base voltage GVSS, through the second pull-down transistor Td2.

If the third pull-up transistor Tu3 is turned on, the third pull-down transistor Td3 may be turned off. At this time, the carry signal CR(n) having a turn-on level voltage interval (e.g., a high-level gate voltage interval) may be output, based on the carry clock signal CR_CLK(n), through the third pull-up transistor Tu3.

If the third pull-up transistor Tu3 is turned off, the third pull-down transistor Td3 may be turned on. At this time, a carry signal CR(n) having a turn-off level voltage interval (e.g., a low-level gate voltage interval) may be output, based on the gate base voltage GVSS, through the third pull-down transistor Td3.

As shown in FIG. 23, the carry signal CR(n) may have the same signal change timing as the scan signal SCAN.

Meanwhile, the level shifter circuit 2210 included in the gate driving circuit 2200 may be implemented as a single integrated circuit chip.

The gate signal outputter 2220 included in the gate driving circuit 2200 may be implemented as one or more integrated circuit chips.

Alternatively, the gate signal outputter 2220 included in the gate driving circuit 2200 may be implemented as a GIP (Gate-In-Panel) type. In this case, the gate signal outputter 2220 may be disposed in a non-display area of the display panel 110 in which scan signal lines SCL, to which scan signals SCAN are applied, and sense signal lines SENL, to which sense signals SENSE are applied, are arranged.

The gate driving circuit 2200 in FIG. 22 may be a circuit implemented by including the first gate driving circuit 130 and the second gate driving circuit 140 shown in FIG. 1.

According to the embodiments of the present disclosure described above, it is possible to improve the image quality by enhancing a charging rate through the overlap driving of subpixels SP.

In addition, according to the embodiments of the present disclosure, it is possible to improve the image quality by preventing a phenomenon in which images are not distinct and images are dragged or a phenomenon of the difference in brightness between subpixel lines through fake data insertion driving in which fake images (e.g., black images, low-grayscale images, etc.) different from real images are intermittently inserted between the real images displayed.

In addition, according to the embodiments of the present disclosure, even if the fake data insertion driving is performed during the overlap driving, it is possible to perform control such that the characteristics of the overlap driving do not change immediately before the fake data insertion driving through the advanced overlap driving in which the voltage interval of a turn-on level voltage of a sense signal SENSE among two gate signals (a scan signal SCAN and a sense signal SENSE) is controlled to be delayed from the voltage interval of a turn-on level voltage of a scan signal SCAN.

As a result, even if the fake data insertion driving is performed during the overlap driving, it is possible to prevent image abnormalities (e.g., a specific-line brightness phenomenon) that occur in a subpixel row (e.g., the $4^{th}$ subpixel row, the $8^{th}$ subpixel row, or the like) immediately before the fake data insertion driving.

Further, the embodiments of the present disclosure are capable of compensating for a reduction in the charging time caused by the advanced overlap driving by increasing the ratio (Ws/Ls) of a channel width Ws to a channel length Ls of a sense transistor SENT in addition to the advanced overlap driving.

It will be apparent to those skilled in the art that various modifications and variations can be made in the present disclosure without departing from the technical idea or scope of the disclosure. Thus, it is intended that the present disclosure cover the modifications and variations of this disclosure provided they come within the scope of the appended claims and their equivalents.

What is claimed is:

1. A gate driving circuit, comprising:

a scan clock signal generator configured to:
receive:
a first reference scan clock signal; and
a second reference scan clock signal; and
generate and output a scan clock signal;

a sense clock signal generator configured to:
receive:
a first reference sense clock signal; and
a second reference sense clock signal; and
generate and output a sense clock signal; and a gate signal outputter configured to:
output a scan signal having a turn-on level voltage interval, based on the scan clock signal; and
output a sense signal having a turn-on level voltage interval, based on the sense clock signal, wherein the second reference scan clock signal rises and falls after the first reference scan clock signal rises and falls, wherein the second reference sense clock signal rises and falls after the first reference sense clock signal rises and falls, wherein a high-level gate voltage interval of the sense clock signal is delayed from a high-level gate voltage interval of the scan clock signal by a predetermined sense shift time, wherein a turn-on level voltage interval of the sense signal is delayed from a turn-on level voltage interval of the scan signal by the sense shift time, wherein the scan clock signal generator is further configured to generate and output the scan clock signal that rises at a rising time of the first reference scan clock signal and falls at a falling time of the second reference scan clock signal, wherein the sense clock signal generator is further configured to generate and output the sense clock signal that rises at a rising time of the second reference sense clock signal, rather than a rising time of the first reference sense clock signal, and falls a predetermined delay time after a falling time of the second reference sense clock signal, and wherein a time interval between the rising time of the first reference sense clock signal and the rising time of the second reference sense clock signal corresponds to the sense shift time.

2. The gate driving circuit of claim 1, wherein:

the rising time of the first reference sense clock signal is the same as the rising time of the first reference scan clock signal; and the rising time of the second reference sense clock signal precedes the rising time of the second reference scan clock signal.

3. The gate driving circuit of claim 1, wherein a length of a time during which the scan clock signal and the sense clock signal overlap each other corresponds to a value obtained by subtracting the delay time from a temporal length of the turn-on level voltage interval of the sense signal.

4. The gate driving circuit of claim 1, wherein:

the scan clock signal generator comprises:
a scan logic unit configured to:
receive the first reference scan clock signal and the second reference scan clock signal; and
generate a scan clock signal that rises at the rising time of the first reference scan clock signal and falls at the falling time of the second reference scan clock signal; and
a scan level shifter configured to output the scan clock signal that rises to a high level gate voltage and falls to a low level gate voltage, and the sense clock signal generator comprises:
a sense logic unit configured to:
receive the first reference sense clock signal and the second reference sense clock signal; and
generate the sense clock signal that rises at the rising time of the second reference sense clock signal, rather than the rising time of the first reference sense clock signal, and falls a predetermined delay time after the falling time of the second reference sense clock signal;
a delay device configured to delay the rising time of the sense clock signal such that the sense clock signal rises at the rising time of the second reference sense clock signal, instead of the rising time of the first reference sense clock signal; and
a sense level shifter configured to output the sense clock signal that rises to the high level gate voltage and falls to the low level gate voltage and that has a high-level gate voltage interval delayed from the high-level gate voltage interval of the scan clock signal by the sense shift time.

5. The gate driving circuit of claim 4, wherein the delay device comprises one or more resistor elements.

6. The gate driving circuit of claim 1, further comprising a carry clock signal generator configured to:
receive:
a first reference carry clock signal; and
a second reference carry clock signal; and
generate and output a carry clock signal.

7. A display device, comprising:

a display panel comprising:
a plurality of data lines;
a plurality of scan signal lines;
a plurality of sense signal lines;
a plurality of reference lines; and
a plurality of subpixels each comprising:
an emission element;
a driving transistor configured to drive the emission element;
a scan transistor configured to control a connection between the data line and a first node of the driving transistor according to a scan signal;
a sense transistor configured to control a connection between the reference line and a second node of the driving transistor according to a sense signal; and a capacitor connected between the first node and the second node of the driving transistor;

a data driving circuit configured to drive the plurality of data lines;

a first gate driving circuit configured to supply a first scan signal having an interval of a turn-on level voltage to a first scan signal line electrically connected to a gate node of the scan transistor in a first subpixel included in the plurality of subpixels; and a second gate driving circuit configured to supply a first sense signal having an interval of a turn-on level voltage, which is delayed from the interval of a turn-on level voltage of the first scan signal by a predetermined sense shift time, to a first sense signal line electrically connected to a gate node of the sense transistor in the first subpixel, wherein the interval of a turn-on level voltage of the first sense signal comprises:

a period in which the interval of a turn-on level voltage of the first sense signal overlaps the interval of a turn-on level voltage of the first scan signal, and a period in which the interval of a turn-on level voltage of the first sense signal does not overlap the interval of a turn-on level voltage of the first scan signal.

8. The display device of claim 7, wherein the period in which the interval of a turn-on level voltage of the first sense signal overlaps the interval of a turn-on level voltage of the first scan signal corresponds to a programming period in which image data is programmed onto the first subpixel.

9. The display device of claim 7, wherein:

a start point of the interval of a turn-on level voltage of the first sense signal is delayed from a start point of the interval of a turn-on level voltage of the first scan signal by the sense shift time; and the sense shift time corresponds to ½ of the interval of a turn-on level voltage of the first scan signal.

10. The display device of claim 7, wherein:

the plurality of subpixels further comprises a second subpixel and a third subpixel;

drain nodes or source nodes of the sense transistors included in the first subpixel, the second subpixel, and the third subpixel are electrically connected to the same reference line; and there is a timing at which the sense transistor in the first subpixel and the sense transistor in the third subpixel are simultaneously turned off while a second scan signal having a turn-on level voltage is supplied to a gate node of the scan transistor in the second subpixel and while a second sense signal having a turn-on level voltage is supplied to a gate node of the sense transistor in the second subpixel.

11. The display device of claim 7, wherein a fake data voltage that is distinct from a real image data voltage is supplied to subpixels arranged in k ("k" is a natural number of 1 or more) subpixel lines during a period between a period in which the $i^{th}$ ("i" is a natural number of 1 or more) scan signal having a turn-on level voltage is supplied to the $i^{th}$ scan signal line of the plurality of scan signal lines and a period in which the $(i+1)^{th}$ scan signal having a turn-on level voltage is supplied to the $(i+1)^{th}$ scan signal line of the plurality of scan signal lines.

12. The display device of claim 11, wherein the fake data voltage is a black data voltage or a low-grayscale data voltage.

13. The display device of claim 7, wherein:

the plurality of subpixels further comprises:

a second subpixel connected to a second scan signal line connected to transmit a second scan signal; and a second sense signal line configured to transmit a second sense signal;

the interval of a turn-on level voltage of the first sense signal is delayed from the interval of a turn-on level voltage of the first scan signal by the sense shift time;

the interval of a turn-on level voltage of the first sense signal overlaps the interval of a turn-on level voltage of the first scan signal by a predetermined programming period;

the interval of a turn-on level voltage of the second sense signal is delayed from the interval of a turn-on level voltage of the second scan signal by the sense shift time;

the interval of a turn-on level voltage of the second sense signal overlaps the interval of a turn-on level voltage of the second scan signal by the programming period;

the interval of a turn-on level voltage of the second scan signal overlaps the interval of a turn-on level voltage of the first scan signal;

the interval of a turn-on level voltage of the second scan signal is delayed from the interval of a turn-on level voltage of the first sense signal by a predetermined scan shift time; and the interval of a turn-on level voltage of the second sense signal does not overlap the interval of a turn-on level voltage of the first scan signal.

14. The display device of claim 7, wherein a ratio of a channel width to a channel length of the sense transistor is greater than a ratio of a channel width to a channel length of the scan transistor.

15. A method for driving a display device, the method comprising:

supplying a first scan signal having an interval of a turn-on level voltage to a first scan signal line connected to a gate node of a scan transistor in a first subpixel among a plurality of subpixels, thereby transmitting an image data voltage supplied to a data line to a first node of a driving transistor in the first subpixel through the scan transistor;

supplying a first sense signal having an interval of a turn-on level voltage, which is delayed from the interval of a turn-on level voltage of the first scan signal by a predetermined sense shift time, to a first sense signal line electrically connected to a gate node of a sense transistor in the first subpixel, thereby transmitting a reference voltage supplied to a reference line to a second node of the driving transistor through the sense transistor; and supplying the first scan signal having the interval of a turn-off level voltage to the first scan signal line and supplying the first sense signal having the interval of a turn-off level voltage to the first sense signal line, wherein the interval of a turn-on level voltage of the first sense signal comprises:

a period in which the interval of a turn-on level voltage of the first sense signal overlaps the interval of a turn-on level voltage of the first scan signal, and a period in which the interval of a turn-on level voltage of the first sense signal does not overlap the interval of a turn-on level voltage of the first scan signal.

16. The method of claim 15, wherein:

a start point of the interval of a turn-on level voltage of the first sense signal is delayed from a start point of the interval of a turn-on level voltage of the first scan signal by the sense shift time; and the sense shift time corresponds to ½ of the interval of a turn-on level voltage of the first scan signal.

17. The method of claim 15, wherein a fake data voltage that is distinct from a real image data voltage is supplied to subpixels arranged in k ("k" is a natural number of 1 or more) subpixel lines during a period between a period in which the $i^{th}$ ("i" is a natural number of 1 or more) scan signal having a turn-on level voltage is supplied to the $i^{th}$ scan signal line of the plurality of scan signal lines and a period in which the $(i+1)^{th}$ scan signal having a turn-on level voltage is supplied to the $(i+1)^{th}$ scan signal line of the plurality of scan signal lines.

* * * * *